US011685155B2

(12) United States Patent
Matsumoto et al.

(10) Patent No.: US 11,685,155 B2
(45) Date of Patent: Jun. 27, 2023

(54) LIQUID EJECTING APPARATUS AND HEAD UNIT

(71) Applicant: Seiko Epson Corporation, Tokyo (JP)

(72) Inventors: Yusuke Matsumoto, Shiojiri (JP); Shunsuke Yamamichi, Shiojiri (JP)

(73) Assignee: SEIKO EPSON CORPORATION

( * ) Notice: Subject to any disclaimer, the term of this patent is extended or adjusted under 35 U.S.C. 154(b) by 77 days.

(21) Appl. No.: 17/486,978

(22) Filed: Sep. 28, 2021

(65) Prior Publication Data

US 2022/0097367 A1 Mar. 31, 2022

(30) Foreign Application Priority Data

Sep. 29, 2020 (JP) ..... 2020-163102

(51) Int. Cl.
*B41J 2/045* (2006.01)
*B41J 2/14* (2006.01)

(52) U.S. Cl.
CPC ..... *B41J 2/04581* (2013.01); *B41J 2/0457* (2013.01); *B41J 2/04573* (2013.01); *B41J 2/04588* (2013.01); *B41J 2/14201* (2013.01); *B41J 2002/14491* (2013.01)

(58) Field of Classification Search
CPC .. B41J 2/04581; B41J 2/0457; B41J 2/04573; B41J 2/04588; B41J 2/14201; B41J 2002/14491; B41J 2002/14419; B41J 2202/20; B41J 2/04541; B41J 2/04593; B41J 2/14233
See application file for complete search history.

(56) References Cited

U.S. PATENT DOCUMENTS

2016/0136950 A1 5/2016 Date

FOREIGN PATENT DOCUMENTS

JP 2010-201647 A 9/2010
JP 2016-093973 A 5/2016

OTHER PUBLICATIONS

IP.com search (Year: 2023).*
Hiyoshi, Teruyuki et al. (EP 3296111 A), "InkJet Printer And Ink Jet Head", Mar. 21, 2018, Paragraphs [0040-0058] (Year: 2018).*

* cited by examiner

*Primary Examiner* — Lisa Solomon
(74) *Attorney, Agent, or Firm* — Harness, Dickey & Pierce, P.L.C.

(57) ABSTRACT

A liquid ejecting apparatus includes a head unit that includes a nozzle that ejects a liquid, a control circuit that outputs a control signal that controls an operation of the head unit, a power supply circuit that supplies a power supply voltage to the head unit, and a liquid container that stores the liquid. The head unit includes a first terminal to which the control signal is input, a second terminal to which the power supply voltage is supplied, and a liquid supply port to which the liquid is supplied, the first terminal and the second terminal are located side by side along a first direction, and the second terminal is located between the first terminal and the liquid supply port in a second direction intersecting the first direction.

10 Claims, 14 Drawing Sheets

| [SIH, SIL] | | [1, 1] (LD) | [1, 0] (MD) | [0, 1] (SD) | [0, 0] (ND) |
|---|---|---|---|---|---|
| S1 | T1 | H | H | H | L |
| | T2 | H | L | L | L |
| S2 | T1 | L | L | L | H |
| | T2 | L | H | L | L |

| TERMINAL NO. | SIGNAL |
|---|---|
| 426-1 | GND |
| 426-2 | VDD |
| 426-3 | GND |
| 426-4 | VHV |
| 426-5 | PS-bp |
| 426-6 | PS-hp |
| 426-7 | PS-enc1 |
| 426-8 | PS-enc2 |

LIQUID EJECTING APPARATUS AND HEAD UNIT

The present application is based on, and claims priority from JP Application Serial Number 2020-163102, filed Sep. 29, 2020, the disclosure of which is hereby incorporated by reference herein in its entirety.

BACKGROUND

1. Technical Field

The present disclosure relates to a liquid ejecting apparatus and a head unit.

2. Related Art

Liquid ejecting apparatuses such as an ink jet printer eject a liquid such as ink filled in a cavity from a nozzle by driving a piezoelectric element provided in a print head of a head unit using a drive signal, and form characters and images on a medium. In such a liquid ejecting apparatus, a control signal for controlling ink ejection in the liquid ejecting apparatus is supplied to the head unit from a main circuit that executes the process via a cable or the like, and ink ejected from the head unit is supplied to the head unit from a liquid container in which the ink is stored via a tube or the like. Then, the head unit forms a desired image on the medium by ejecting a predetermined amount of ink at a timing based on the input control signal.

For example, JP-A-2016-093973 discloses a head unit that ejects ink stored in a liquid container, and a liquid ejecting apparatus in which a control signal for controlling ejection of the ink is propagated by two cables.

In a liquid ejecting apparatus as described in JP-A-2016-093973, since a tube for supplying a liquid from a liquid container is coupled to the head unit in addition to a cable for signal transfer, it is necessary to remove the cable and the tube during maintenance of the head unit. When the cable and the tube are removed for such maintenance or the like, the liquid flowing through the tube may leak. When the leaked liquid adheres to the cable or a conductive portion of a connector to which the cable is mounted, a short circuit may occur between the cable and the conductive portion of the connector to which the cable is mounted, and as a result, the operation of the liquid ejecting apparatus may be affected. There is no description in the liquid ejecting apparatus described in JP-A-2016-093973 with respect to the problem caused by the leakage of liquid due to such removal of the tube or the like, and there thus is room for improvement.

In particular, in response to the recent increase in market demand for miniaturization of head units and improvement of maintainability, the distance between a cable through which a signal propagates and a connector to which the cable is mounted and a tube for supplying ink and a supply port to which the tube is mounted becomes narrower, and the problem caused by the leakage of liquid due to the removal of the tube or the like is remarkable. Therefore, it is strongly required to reduce the possibility that the operational stability of the liquid ejecting apparatus is lowered due to the leaked liquid.

SUMMARY

According to an aspect of the present disclosure, there is provided a liquid ejecting apparatus including a head unit that includes a nozzle that ejects a liquid, a control circuit that outputs a control signal that controls an operation of the head unit, a power supply circuit that supplies a power supply voltage to the head unit, and a liquid container that stores the liquid, in which the head unit includes a first terminal to which the control signal is input, a second terminal to which the power supply voltage is supplied, and a liquid supply port to which the liquid is supplied, the first terminal and the second terminal are located side by side along a first direction, and the second terminal is located between the first terminal and the liquid supply port in a second direction intersecting the first direction.

According to another aspect of the present disclosure, there is provided a head unit including a first terminal to which a control signal is input, a second terminal to which a power supply voltage is supplied, and a liquid supply port to which the liquid is supplied, in which the second terminal is located between the first terminal and the liquid supply port in a second direction intersecting a first direction in which the first terminal and the second terminal are arranged.

DESCRIPTION OF EXEMPLARY EMBODIMENTS

Hereinafter, preferred embodiments of the present disclosure will be described with reference to the drawings. The drawings used are for convenience of description. The embodiments to be described below do not unduly limit the contents of the present disclosure described in the scope of claims. In addition, all of the configurations to be described below are not necessarily essential configuration requirements of the present disclosure.

1. Functional Configuration of Liquid Ejecting Apparatus

First, the functional configuration of a liquid ejecting apparatus 1 according to the present embodiment will be described with reference to FIGS. 1A and 1B. The liquid ejecting apparatus 1 according to the present embodiment will be described by taking, as an example, an ink jet printer that forms a desired image on a medium by ejecting ink as an example of a liquid onto the medium. Such a liquid ejecting apparatus 1 receives image data from an external device such as a computer provided externally by wired communication or wireless communication, and forms an image on a medium based on the received image data.

Figure 1A:
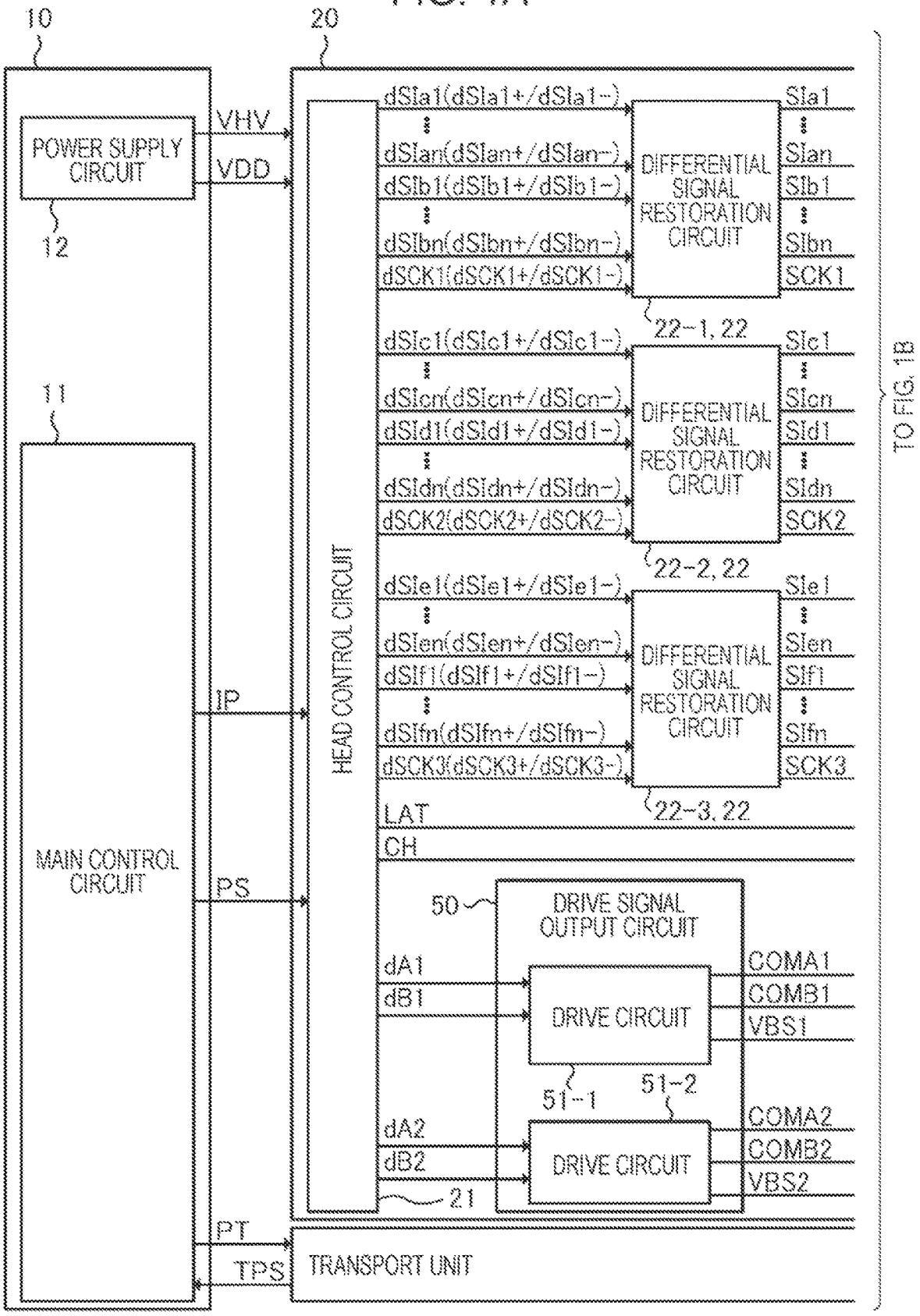
FIGS. 1A and 1B are diagrams showing a functional configuration of a liquid ejecting apparatus.
Figure 1B:
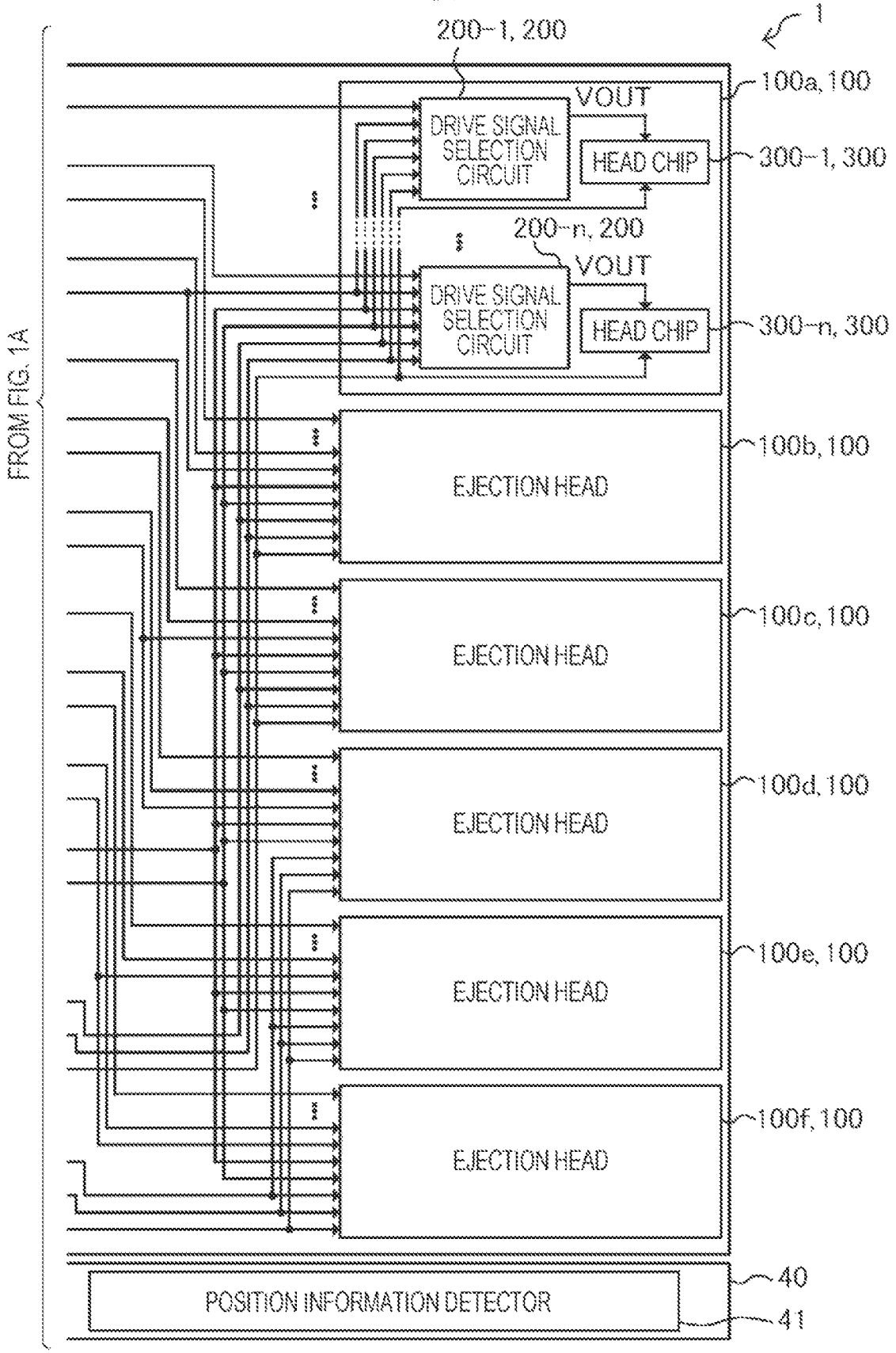

FIGS. 1A and 1B are diagrams showing a functional configuration of the liquid ejecting apparatus 1. As shown in FIGS. 1A and 1B, the liquid ejecting apparatus 1 includes a control unit 10, a head unit 20, and a transport unit 40. The control unit 10 has a main control circuit 11 and a power supply circuit 12.

A commercial voltage, which is an AC voltage, is input to the power supply circuit 12 from a commercial AC power supply (not shown) provided outside the liquid ejecting apparatus 1. The power supply circuit 12 generates a voltage VHV which is a DC voltage having a voltage value of 42 V and a voltage VDD which is a DC voltage having a voltage value of 5 V based on the input commercial voltage, and outputs the voltages to the head unit 20. Such a power supply circuit 12 is an AC/DC converter that converts an AC voltage into a DC voltage, and includes, for example, a flyback circuit and the like, and a DC/DC converter and the like that convert the voltage value of the DC voltage output by the flyback circuit. The voltages VHV and VDD generated by the power supply circuit 12 are supplied to the head unit 20 and used as power supply voltages having various configurations of the head unit 20. That is, the power supply circuit 12 supplies the power supply voltage to the head unit 20. Further, the voltages VHV and VDD may also be used as the power supply voltage of each portion of the liquid ejecting apparatus 1 including the control unit 10 and the transport unit 40. In addition to the voltages VHV and VDD, the power supply circuit 12 may generate voltage signals of voltage values used in each portion of the liquid ejecting apparatus 1 including the control unit 10, the head unit 20, and the transport unit 40, and output the voltage signals to each corresponding configuration.

An image signal is input to the main control circuit 11 from an external device such as a host computer provided outside the liquid ejecting apparatus 1 via an interface circuit (not shown). The main control circuit 11 generates various signals for forming an image on the medium according to the input image signal, and outputs the signals to the corresponding configurations.

Further, the main control circuit 11 generates a transport control signal PT for transporting a medium on which an image based on an image signal is formed based on the image signal input from an external device, and outputs the transport control signal to the transport unit 40. In addition, the transport unit 40 includes a position information detector 41 that detects the transport position of the medium to be transported. The position information detector 41 generates a transport position information signal TPS indicating the transport position of the medium to be transported, and outputs the transport position information signal to the main control circuit 11. The main control circuit 11 calculates the transport position of the medium based on the input transport position information signal TPS, generates a position information signal PS indicating the calculated transport position of the medium, and outputs the position information signal to the head unit 20. The head unit 20 grasps the transport position of the medium based on the input position information signal PS, and ejects the ink to a desired position of the medium. That is, the position information detector 41 outputs the transport position information signal TPS based on a relative positional relationship between the head unit 20 and the medium on which the liquid is ejected. Examples of such a position information detector 41 include an encoder that detects the transport position of the medium based on the rotation angle or the like of a motor that controls the transport of the medium, and various sensor elements that detect the transport position of the medium by light.

Here, the transport position information signal TPS output by the position information detector 41 is an example of a position information signal. Further, the transport position information signal TPS output by the position information detector 41 may be directly supplied to the head unit 20 without going through the control unit 10. That is, in addition to the transport position information signal TPS output by the position information detector 41, the position information signal PS based on the transport position information signal TPS is also an example of a position information signal.

Here, the signal based on the relative positional relationship means a signal indicating a positional relationship between the medium and the head unit 20 in a broad sense. That is, in the present embodiment, since the liquid ejecting apparatus 1 exemplifies a so-called line-type ink jet printer in which ink is ejected from the head unit 20 fixed to an outer shell or the like with respect to a medium to be transported, a signal based on the relative positional relationship will be described as a signal indicating the transport position of a medium P as the signal based on the relative positional relationship. Here, when the liquid ejecting apparatus 1 is a so-called serial type ink jet printer in which ink is ejected from the head unit 20 that moves in a direction intersecting the transport direction of the medium with respect to the medium to be transported, the signal based on the relative positional relationship also includes a signal indicating the scanning position of the head unit 20 moving along the direction intersecting the transport direction in addition to the signal indicating the transport position of the medium P.

Further, the main control circuit 11 performs predetermined image processing on an image signal input from an external device, and then outputs the image-processed signal to the head unit 20 as an image information signal IP. The image information signal IP output from the main control circuit 11 is an electric signal such as a differential signal, and is output as, for example, a signal based on a peripheral component interconnect express (PCIe) communication standard. Here, examples of the image processing executed by the main control circuit 11 include color conversion processing for converting the image signal input from the external device into color information of red, green, and blue and then converting the converted color information into color information corresponding to the color of the ink ejected from the liquid ejecting apparatus 1, and halftone processing for binarizing color information that has undergone the color conversion processing. The image processing executed by the main control circuit 11 is not limited to the color conversion processing and the halftone processing described above.

As described above, the main control circuit 11 generates the image information signal IP and the position information signal PS that control the operation of the head unit 20 and outputs the signals to the head unit 20. Such a main control circuit 11 includes, for example, a system on a chip (SoC) including one or a plurality of semiconductor devices having a plurality of functions. The main control circuit 11 that outputs the image information signal IP that controls the operation of the head unit 20 is an example of a control circuit, and the image information signal IP is an example of a control signal.

The head unit 20 includes a head control circuit 21, differential signal restoration circuits 22-1 to 22-3, a drive signal output circuit 50, and ejection heads 100*a* to 100*f*, and ejects ink as an example of a liquid from a nozzle which will be described later.

The head control circuit 21 outputs a control signal for controlling each portion of the head unit 20 based on the image information signal IP and the position information signal PS input from the main control circuit 11. Specifically, the head control circuit 21 generates differential signals dSCK1 to dSCK3 and differential signals dSIa1 to dSIan, dSIb1 to dSIbn, dSIc1 to dSIcn, dSId1 to dSIdn, dSIe1 to dSIen, and dSIf1 to dSIfn obtained by converting a control signal for controlling the ejection of ink from the ejection head 100 into a differential signal based on the image information signal IP and the position information signal PS, and outputs the signals to the differential signal restoration circuits 22-1 to 22-3.

The differential signal restoration circuits 22-1 to 22-3 restores the input differential signals dSCK1 to dSCK3 and differential signals dSIa1 to dSIan, dSIb1 to dSIbn, dSIc1 to dSIcn, dSId1 to dSIdn, dSIe1 to dSIen, and dSIf1 to dSIfn into corresponding clock signals SCK1 to SCK3 and print data signals SIa1 to SIan, SIb1 to SIbn, SIc1 to SIcn, SId1 to SIdn, SIe1 to SIen, and SIf1 to SIfn, respectively, and outputs the signals to the corresponding ejection heads 100*a* to 100*f*.

Specifically, the head control circuit 21 generates a differential signal dSCK1 including a pair of signals dSCK1+ and dSCK1−, differential signals dSIa1 to dSIan including a pair of signals dSIa1+ to dSIan+, and dSIa1− to dSIan−, and differential signals dSIb1 to dSIbn including a pair of signals dSIb1+ to dSIbn+ and dSIb1− to dSIbn−, and outputs the signals the differential signal restoration circuit 22-1. The differential signal restoration circuit 22-1 generates a clock signal SCK1, which is a corresponding single-ended signal, by restoring the input differential signal dSCK1, and outputs the clock signal to the ejection heads 100*a* and 100*b*, generates print data signals SIa1 to SIan, which are corresponding single-ended signals, by restoring the differential signals dSIa1 to dSIan, and outputs the signals to the ejection head 100*a*, and generates print data signals SIb1 to SIbn, which are corresponding single-ended signals, by restoring the differential signals dSIb1 to dSIbn, and outputs the signals to the ejection head 100*b*.

In addition, the head control circuit 21 generates a differential signal dSCK2 including a pair of signals dSCK2+ and dSCK2−, differential signals dSIc1 to dSIcn including a pair of signals dSIc1+ to dSIcn+, and dSIc1− to dSIcn−, and differential signals dSId1 to dSIdn including a pair of signals dSId1+ to dSIdn+ and dSId1− to dSIdn−, and outputs the signals the differential signal restoration circuit 22-2. The differential signal restoration circuit 22-2 generates a clock signal SCK2, which is a corresponding single-ended signal, by restoring the input differential signal dSCK2, and outputs the clock signal to the ejection heads 100*c* and 100*d*, generates print data signals SIc1 to SIcn, which are corresponding single-ended signals, by restoring the differential signals dSIc1 to dSIcn, and outputs the signals to the ejection head 100*c*, and generates print data signals SId1 to SIdn, which are corresponding single-ended signals, by restoring the differential signals dSId1 to dSIdn, and outputs the signals to the ejection head 100*d*.

Similarly, the head control circuit 21 generates a differential signal dSCK3 including a pair of signals dSCK3+ and dSCK3−, differential signals dSIe1 to dSIen including a pair of signals dSIe1+ to dSIen+, and dSIe1− to dSIen−, and differential signals dSIf1 to dSIfn including a pair of signals dSIf1+ to dSIfn+ and dSIf1− to dSIfn−, and outputs the signals the differential signal restoration circuit 22-3. The differential signal restoration circuit 22-3 generates a clock signal SCK3, which is a corresponding single-ended signal, by restoring the input differential signal dSCK3, and outputs the clock signal to the ejection heads 100*e* and 100*f*, generates print data signals SIe1 to SIen, which are corresponding single-ended signals, by restoring the differential signals dSIe1 to dSIen, and outputs the signals to the ejection head 100*e*, and generates print data signals SIf1 to SIfn, which are corresponding single-ended signals, by restoring the differential signals dSIf1 to dSIfn, and outputs the signals to the ejection head 100*f*.

Here, each of the differential signals dSCK1 to dSCK3 and the differential signals dSIa1 to dSIan, dSIb1 to dSIbn, dSIc1 to dSIcn, dSId1 to dSIdn, dSIe1 to dSIen, and dSIf1 to dSIfn output from the head control circuit 21 may be a differential signal of a low voltage differential signaling (LVDS) transfer method, or a differential signal of various high-speed communication methods such as low voltage positive emitter coupled logic (LVPECL) or current mode logic (CML) other than LVDS.

The head unit 20 may have a differential signal generation circuit that generates a differential signal, and the head control circuit 21 may output, to the differential signal generation circuit, basic control signals oSCK1 to oSCK3 which are the basis of the differential signals dSCK1 to dSCK3 and basic control signals oSIa1 to oSIan, oSIb1 to oSIbn, oSIc1 to oSIcn, oSId1 to oSIdn, oSIe1 to oSIen, and oSIf1 to oSIfn which are the basis of the differential signals dSIa1 to dSIan, dSIb1 to dSIbn, dSIc1 to dSIcn, dSId1 to dSIdn, dSIe1 to dSIen, and dSIf1 to dSIfn, and the differential signal generation circuit may generate the differential signals dSCK1 to dSCK3 and the differential signals dSIa1 to dSIan, dSIb1 to dSIbn, dSIc1 to dSIcn, dSId1 to dSIdn, dSIe1 to dSIen, and dSIf1 to dSIfn based on the input basic control signals oSCK1 to oSCK3, the basic control signals oSIa1 to oSIan, oSIb1 to oSIbn, oSIc1 to oSIcn, oSId1 to oSIdn, oSIe1 to oSIen, and oSIf1 to oSIfn, and output the signals to each of the differential signal restoration circuits 22-1 to 22-3.

Further, the head control circuit 21 generates a latch signal LAT and a change signal CH as control signals for controlling the ink ejection timing from the ejection heads 100*a* to 100*d* based on the image information signal IP input from the main control circuit 11, and outputs the signals to the ejection heads 100*a* to 100*d*.

Further, the head control circuit 21 generates basic drive signals dA1, dB1, dA2, and dB2 which are the basis of drive signals COMA1, COMA2, COMB1, and COMB2 for driving the ejection heads 100*a* to 100*d* based on the image information signal IP input from the main control circuit 11, and outputs the signals to the drive signal output circuit 50.

The drive signal output circuit 50 includes drive circuits 51-1 and 51-2. The basic drive signals dA1 and dB1 are input to the drive circuit 51-1. The drive circuit 51-1 generates the drive signal COMA1 by converting the input basic drive signal dA1 into an analog signal and then amplifying the converted analog signal in class D based on the voltage VHV, and outputs the drive signal to the ejection heads 100*a*, 100*b*, and 100*c*, and generates the drive signal COMB1 by converting the input basic drive signal dB1 into an analog signal and then amplifying the converted analog signal in class D based on the voltage VHV, and outputs the drive signal to the ejection heads 100*a*, 100*b*, and 100*c*. Further, the drive circuit 51-1 generates a reference voltage signal VBS1 which is a reference potential when ink is ejected from the ejection heads 100*a*, 100*b*, and 100*c* by boosting or stepping down the voltage VDD, and outputs the reference voltage signal to the ejection heads 100*a*, 100*b*, and 100*c*. That is, the drive circuit 51-1 includes two class D amplifier circuits that generate drive signals COMA1 and COMB1 and a step-down circuit or booster circuit that generates a reference voltage signal VBS1.

Further, the basic drive signals dA2 and dB2 are input to the drive circuit 51-2. The drive circuit 51-2 generates the drive signal COMA2 by converting the input basic drive signal dA2 into an analog signal and then amplifying the converted analog signal in class D based on the voltage VHV, and outputs the drive signal to the ejection heads 100*d*, 100*e*, and 100*f*, and generates the drive signal COMB2 by converting the input basic drive signal dB2 into an analog signal and then amplifying the converted analog signal in class D based on the voltage VHV, and outputs the drive signal to the ejection heads 100*d*, 100*e*, and 100*f*. Further, the drive circuit 51-2 generates a reference voltage signal VBS2 which is a reference potential when ink is ejected from the ejection heads 100*d*, 100*e*, and 100*f* by boosting or stepping down the voltage VDD, and outputs the reference voltage signal to the ejection heads 100*d*, 100*e*, and 100*f*. That is, the drive circuit 51-2 includes two class D amplifier circuits that generate drive signals COMA2 and COMB2, and a step-down circuit or booster circuit that generates a reference voltage signal VBS2.

Here, in the present embodiment, the description has been made that the drive circuit 51-1 generates the drive signals COMA1 and COMB1 and the reference voltage signal VBS1, and outputs the signals to the ejection heads 100*a*, 100*b*, and 100*c*, and the drive circuit 51-2 generates the drive signals COMA2 and COMB2 and the reference voltage signal VBS2, and outputs the signals to the ejection heads 100*d*, 100*e*, and 100*f*. However, the present disclosure is not limited thereto. For example, the drive signals COMA1 and COMB1 and the reference voltage signal VBS1 output by the drive circuit 51-1 and the drive signals COMA2 and COMB2 and the reference voltage signal VBS2 output by the drive circuit 51-2 may be input to each of the ejection heads 100*a* to 100*f* in common. Further, the drive signal output circuit 50 may include a drive circuit 51-3 (not shown) that generates drive signals COMA3 and COMB3 and a reference voltage signal VBS3, and the drive circuit 51-1 may generate the drive signals COMA1 and COMB1 and the reference voltage signal VBS1, and output the signals to the ejection heads 100*a* and 100*b*, the drive circuit 51-2 may generate the drive signals COMA2 and COMB2 and the reference voltage signal VBS2, and output the signals to the ejection heads 100*c* and 100*d*, and the drive circuit 51-3 may generate the drive signals COMA3 and COMB3 and the reference voltage signal VBS3, and output the signals to the ejection heads 100*e* and 100*f*. Further, a common reference voltage signal VBS may be supplied to the ejection heads 100*a* to 100*f*. The drive circuits 51-1 and 51-2 need only be able to amplify the analog signals corresponding to the input basic drive signals dA1, dB1, dA2, and dB2 based on the voltage VHV, and may include a class A amplifier circuit, a class B amplifier circuit, or a class AB amplifier circuit.

The ejection head 100*a* has drive signal selection circuits 200-1 to 200-*n* and head chips 300-1 to 300-*n* corresponding to the drive signal selection circuits 200-1 to 200-*n*, respectively.

The print data signal SIa1, the clock signal SCK1, the latch signal LAT, the change signal CH, and the drive signals COMA1 and COMB1 are input to the drive signal selection circuit 200-1 included in the ejection head 100*a*. The drive signal selection circuit 200-1 included in the ejection head 100*a* generates a drive signal VOUT by selecting or not selecting the waveform included in the drive signals COMA1 and COMB1 at the timing defined by the latch signal LAT and the change signal CH based on the print data signal SIa1, and supplies the drive signal to the head chip 300-1 included in the ejection head 100*a*. Thereby, a piezoelectric element 60, which will be described later, of the head chip 300-1 is driven, and ink is ejected from the corresponding nozzles as the piezoelectric element 60 is driven.

Similarly, the print data signal SIan, the clock signal SCK1, the latch signal LAT, the change signal CH, and the drive signals COMA1 and COMB1 are input to the drive signal selection circuit 200-*n* included in the ejection head 100*a*. The drive signal selection circuit 200-*n* included in the ejection head 100*a* generates a drive signal VOUT by selecting or not selecting the waveform included in the drive signals COMA1 and COMB1 at the timing defined by the latch signal LAT and the change signal CH based on the print data signal SIan, and supplies the drive signal to the head chip 300-*n* included in the ejection head 100*a*. Thereby, a piezoelectric element 60, which will be described later, of the head chip 300-*n* is driven, and ink is ejected from the corresponding nozzles as the piezoelectric element 60 is driven.

That is, each of the drive signal selection circuits 200-1 to 200-*n* switches whether or not to supply the drive signals COMA and COMB as the drive signals VOUT to the piezoelectric elements 60 included in the corresponding head chips 300-1 to 300-*n*. Here, the ejection head 100*a* and the ejection heads 100*b* to 100*f* differ only in the input signal, and the configuration and operation are the same. Therefore, the description of the configuration and operation of the ejection heads 100*b* to 100*f* will be omitted. Further, in the following description, when it is not necessary to particularly distinguish the ejection heads 100*a* to 100*f*, they may be simply referred to as the ejection head 100. Further, the drive signal selection circuits 200-1 to 200-*n* included in the ejection head 100 all have the same configuration, and the head chips 300-1 to 300-*n* all have the same configuration. Therefore, when it is not necessary to distinguish the drive signal selection circuits 200-1 to 200-*n*, they are simply referred to as the drive signal selection circuit 200, and the description has been made that the drive signal selection circuit 200 supplies the drive signal VOUT to the head chip 300. In this case, the description has been made that the print data signal SI, the clock signal SCK, the latch signal LAT, the change signal CH, and the drive signals COMA and COMB are input to the drive signal selection circuit 200.

2. Configuration and Operation of Drive Signal Selection Circuit

Next, the configuration and operation of the drive signal selection circuit 200 will be described. As described above, the drive signal selection circuit 200 generates a drive signal VOUT by selecting or not selecting the waveforms of the input drive signals COMA and COMB, and outputs the drive signal to the corresponding head chip 300. Therefore, in describing the configuration and operation of the drive signal selection circuit 200, first, an example of the waveforms of the drive signals COMA and COMB input to the drive signal selection circuit 200 and an example of the waveform of the drive signal VOUT output by the drive signal selection circuit 200 will be described.

Figure 2:
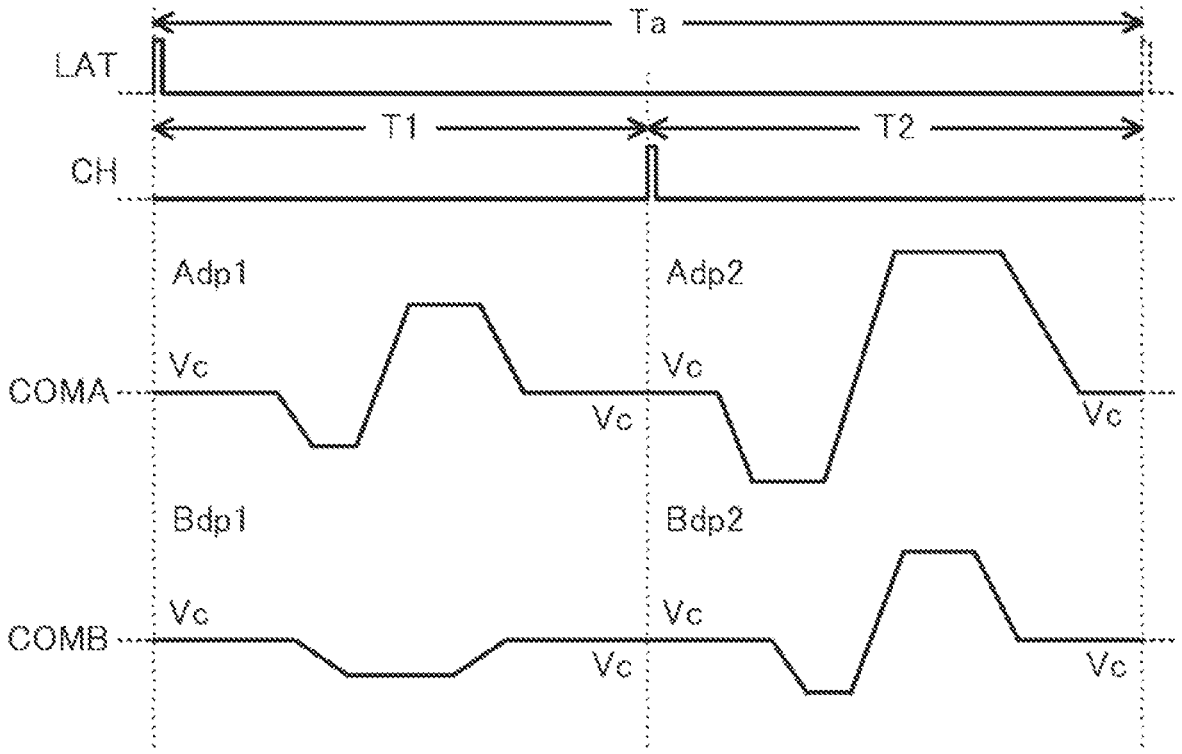
FIG. 2 is a diagram showing an example of waveforms of drive signals.

FIG. 2 is a diagram showing an example of waveforms of drive signals COMA and COMB. As shown in FIG. 2, the drive signal COMA is a waveform in which a trapezoidal waveform Adp1 arranged in a period T1 from the rise of the latch signal LAT to the rise of the change signal CH and a trapezoidal waveform Adp2 arranged in a period T2 from the rise of the change signal CH to the rise of the latch signal LAT are continuous. When the trapezoidal waveform Adp1 is supplied to the head chip 300, a small amount of ink is ejected from the corresponding nozzle of the head chip 300, and when the trapezoidal waveform Adp2 is supplied to the head chip 300, a medium amount of ink, more than a small amount, is ejected from the corresponding nozzle of the head chip 300.

Further, as shown in FIG. 2, the drive signal COMB is a waveform in which a trapezoidal waveform Bdp1 arranged in the period T1 and a trapezoidal waveform Bdp2 arranged in the period T2 are continuous. When the trapezoidal waveform Bdp1 is supplied to the head chip 300, ink is not ejected from the corresponding nozzle of the head chip 300. The trapezoidal waveform Bdp1 is a waveform for slightly vibrating the ink near the opening of the nozzle to prevent an increase in ink viscosity. Further, when the trapezoidal waveform Bdp2 is supplied to the head chip 300, a small amount of ink is ejected from the corresponding nozzle of the head chip 300, as in the case where the trapezoidal waveform Adp1 is supplied.

Here, as shown in FIG. 2, the voltage values at the start timing and end timing of each of the trapezoidal waveforms Adp1, Adp2, Bdp1, and Bdp2 are all common to a voltage Vc. That is, each of the trapezoidal waveforms Adp1, Adp2, Bdp1, and Bdp2 is a waveform that starts at a voltage Vc and ends at a voltage Vc. A cycle Ta including the period T1 and the period T2 corresponds to a printing cycle for forming new dots on the medium.

In FIG. 2, although the trapezoidal waveform Adp1 and the trapezoidal waveform Bdp2 are shown as having the same waveform, the trapezoidal waveform Adp1 and the trapezoidal waveform Bdp2 may have different waveforms. Further, the description has been made that a small amount of ink is ejected from the corresponding nozzles in both the case where the trapezoidal waveform Adp1 is supplied to the head chip 300 and the case where the trapezoidal waveform Bdp1 is supplied to the head chip 300. However, the present disclosure is not limited thereto. That is, the waveforms of the drive signals COMA and COMB are not limited to the example shown in FIG. 2, and a signal having various combinations of waveforms may be used depending on the properties of the ink ejected from the nozzle of the head chip 300, the material of the medium on which the ink lands, and the like. Further, the drive signal COMA1 and the drive signal COMA2 may have different waveforms, and similarly, the drive signal COMB1 and the drive signal COMB2 may have different waveforms.

Figure 3:
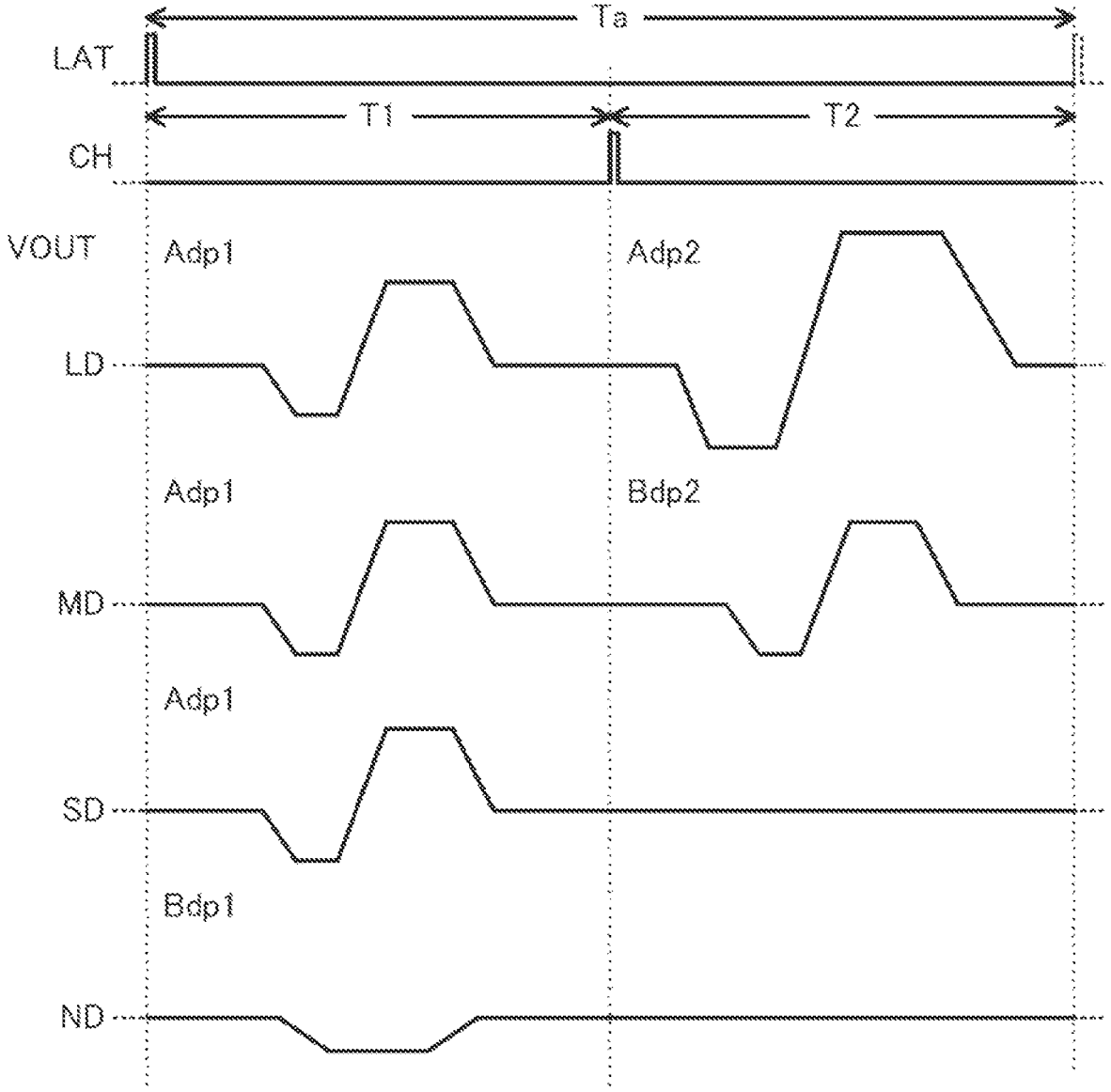
FIG. 3 is a diagram showing an example of a waveform of a drive signal.

FIG. 3 is a diagram showing an example of the waveform of the drive signal VOUT corresponding to each of a large dot LD, a medium dot MD, a small dot SD, and a non-recording ND in the size of the dots formed on the medium.

As shown in FIG. 3, the drive signal VOUT when the large dot LD is formed on the medium is a waveform in which the trapezoidal waveform Adp1 arranged in the period T1 and the trapezoidal waveform Adp2 arranged in the period T2 are continuous in the cycle Ta. When this drive signal VOUT is supplied to the head chip 300, a small amount of ink and a medium amount of ink are ejected from the corresponding nozzles. Therefore, in the cycle Ta, each ink lands on the medium and coalesces, so that the large dot LD is formed on the medium.

Further, the drive signal VOUT when the medium dot MD is formed on the medium is a waveform in which the trapezoidal waveform Adp1 arranged in the period T1 and the trapezoidal waveform Bdp2 arranged in the period T2 are continuous in the cycle Ta. When this drive signal VOUT is supplied to the head chip 300, a small amount of ink is ejected twice from the corresponding nozzles. Therefore, in the cycle Ta, each ink lands on the medium and coalesces, so that the medium dot MD is formed on the medium.

The drive signal VOUT when the small dot SD is formed on the medium is a waveform in which the trapezoidal waveform Adp1 arranged in the period T1 and a constant waveform at the voltage Vc arranged in the period T2 are continuous in the cycle Ta. When this drive signal VOUT is supplied to the head chip 300, a small amount of ink is ejected once from the corresponding nozzle. Therefore, in the cycle Ta, the ink lands on the medium, and the small dot SD is formed on the medium.

The drive signal VOUT corresponding to the non-recording ND that does not form dots on the medium is a waveform in which the trapezoidal waveform Bdp1 arranged in the period T1 and a constant waveform at the voltage Vc arranged in the period T2 are continuous in the cycle Ta. When this drive signal VOUT is supplied to the head chip 300, the ink in the vicinity of the opening of the corresponding nozzle only slightly vibrates, and the ink is not ejected. Therefore, in the cycle Ta, the ink does not land on the medium and dots are not formed on the medium.

Here, the constant waveform at the voltage Vc is the voltage supplied to the head chip 300 when none of the trapezoidal waveforms Adp1, Adp2, Bdp1, and Bdp2 is selected as the drive signal VOUT, and specifically, is a waveform of a voltage value in which a voltage Vc immediately before the trapezoidal waveforms Adp1, Adp2, Bdp1, and Bdp2 is held in the head chip 300. Therefore, when none of the trapezoidal waveforms Adp1, Adp2, Bdp1, and Bdp2 is selected as the drive signal VOUT, the voltage Vc is supplied to the head chip 300 as the drive signal VOUT.

Figure 4:
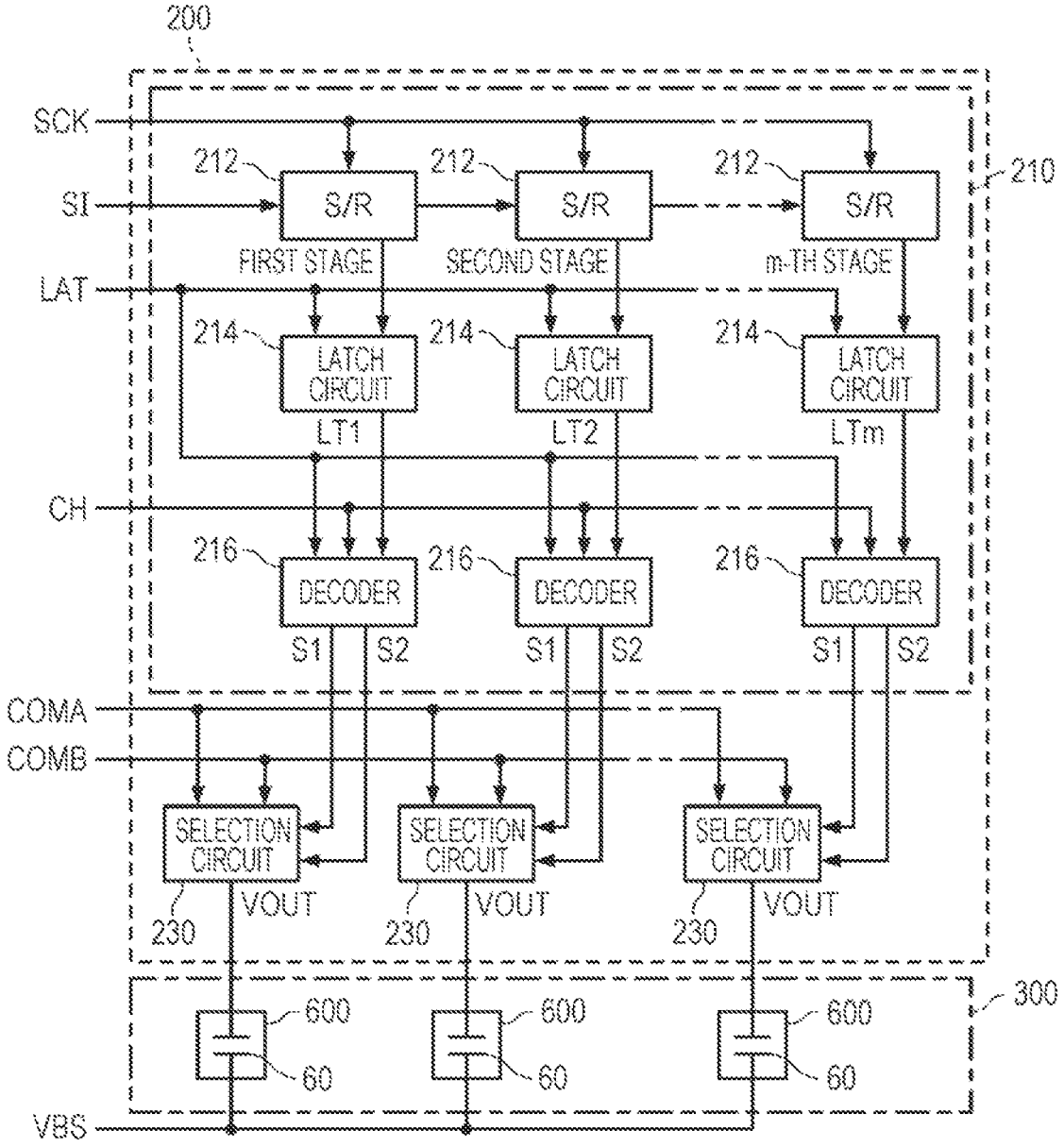
FIG. 4 is a diagram showing a configuration of a drive signal selection circuit.

Next, the configuration and operation of the drive signal selection circuit 200 will be described. FIG. 4 is a diagram showing the configuration of the drive signal selection circuit 200. As shown in FIG. 4, the drive signal selection circuit 200 includes a selection control circuit 210 and a plurality of selection circuits 230. Further, FIG. 4 shows an example of the head chip 300 to which the drive signal VOUT output from the drive signal selection circuit 200 is supplied. As shown in FIG. 4, the head chip 300 includes m ejection portions 600 each having a piezoelectric element 60.

The print data signal SI, the latch signal LAT, the change signal CH, and the clock signal SCK are input to the selection control circuit 210. The selection control circuit 210 is provided with a set of a shift register (S/R) 212, a latch circuit 214, and a decoder 216 corresponding to each of the m ejection portions 600 of the head chip 300. That is, the drive signal selection circuit 200 includes a set of the same number of shift registers 212, latch circuits 214, and decoders 216 as the m ejection portions 600 of the head chip 300.

The print data signal SI is a signal synchronized with the clock signal SCK, and a signal having a total of 2 m bits including 2-bit print data [SIH, SIL] for selecting one of large dot LD, medium dot MD, small dot SD, and non-recording ND with respect to each of the m ejection portions 600. The input print data signal SI is held in the shift register 212 for each of the two bits of print data [SIH, SIL] included in the print data signal SI, corresponding to the m ejection portions 600. Specifically, in the selection control circuit 210, the m-th stage shift registers 212 corresponding to the m ejection portions 600 are vertically coupled to each other, and the print data [SIH, SIL] serially input as the print data signal SI is sequentially transferred to the subsequent stage according to the clock signal SCK. In FIG. 4, in order to distinguish the shift register 212, the shift register 212 to which the print data signal SI is input is described as a first stage, a second stage, . . . , an m-th stage in order from the upstream.

Each of the m latch circuits 214 latches the 2-bit print data [SIH, SIL] held by each of the m shift registers 212 at the rise of the latch signal LAT.

Figures 5, 6:
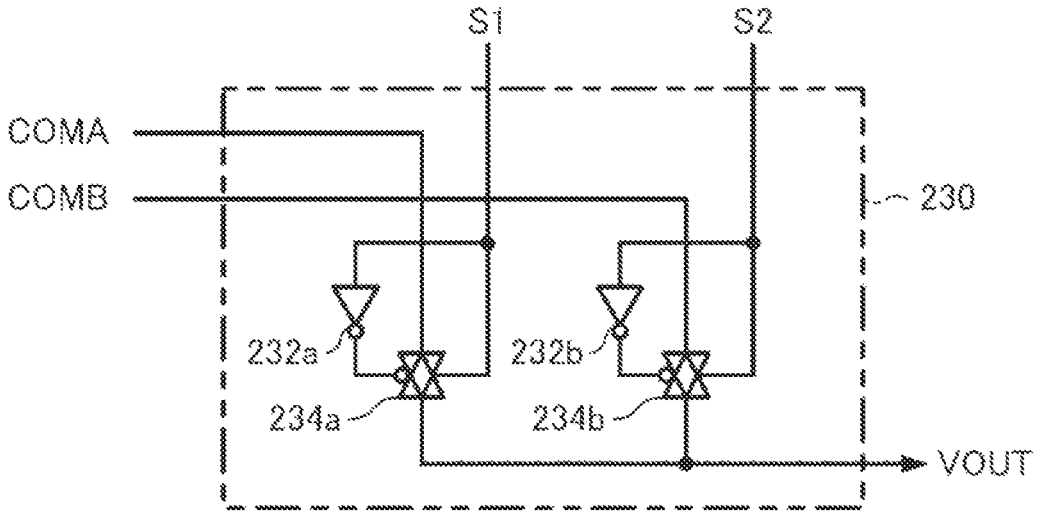
FIG. 5 is a diagram showing decoding contents in a decoder.
FIG. 6 is a diagram showing a configuration of a selection circuit corresponding to one ejection portion.

FIG. 5 is a diagram showing the decoding contents in the decoder 216. The decoder 216 outputs the selection signals S1 and S2 according to the latched 2-bit print data [SIH, SIL]. For example, when the 2-bit print data [SIH, SIL] is [1,0], the decoder 216 outputs the logic level of the selection signal S1 as H and L levels in the periods T1 and T2, and outputs the logic level of the selection signal S2 as L and H levels in the periods T1 and T2 to the selection circuit 230.

The selection circuit 230 is provided corresponding to each of the ejection portions 600. That is, the number of selection circuits 230 included in the drive signal selection circuit 200 is m, which is the same as the number of ejection portions 600 in the corresponding head chip 300. FIG. 6 is a diagram showing a configuration of a selection circuit 230 corresponding to one ejection portion 600. As shown in FIG. 6, the selection circuit 230 has inverters 232*a* and 232*b*, which are NOT circuits, and transfer gates 234*a* and 234*b*.

The selection signal S1 is input to the positive control end not marked with a circle at the transfer gate 234*a*, while being logically inverted by the inverter 232*a* and input to the negative control end marked with a circle at the transfer gate 234*a*. Further, the drive signal COMA is supplied to the input end of the transfer gate 234*a*. The selection signal S2 is input to the positive control end not marked with a circle at the transfer gate 234*b*, while being logically inverted by the inverter 232*b* and input to the negative control end marked with a circle at the transfer gate 234*b*. Further, the drive signal COMB is supplied to the input end of the transfer gate 234*b*. The output ends of the transfer gates 234*a* and 234*b* are commonly coupled, and the drive signal VOUT is output from the output ends.

Specifically, the transfer gate 234*a* makes between the input end and the output end conductive when the selection signal S1 is H level, and makes between the input end and the output end non-conductive when the selection signal S1 is L level. Further, the transfer gate 234*b* makes between the input end and the output end conductive when the selection signal S2 is H level, and makes between the input end and the output end non-conductive when the selection signal S2 is L level. That is, the selection circuit 230 selects the waveforms of the drive signals COMA and COMB based on the input selection signals S1 and S2, and outputs the drive signal VOUT of the selected waveform.

Figure 7:
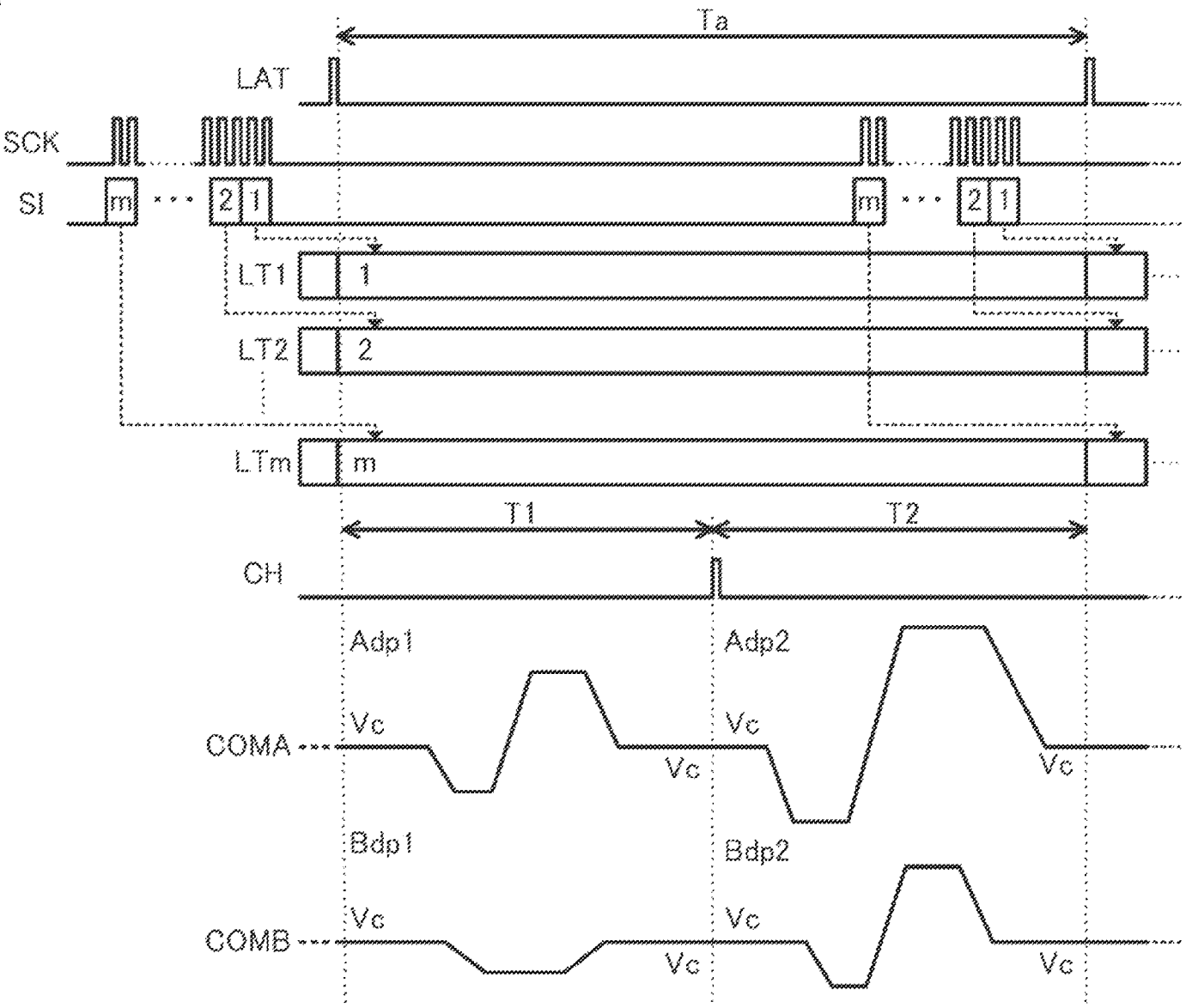
FIG. 7 is a diagram for describing the operation of the drive signal selection circuit.

The operation of the drive signal selection circuit 200 will be described with reference to FIG. 7. FIG. 7 is a diagram for describing the operation of the drive signal selection circuit 200. The print data [SIH, SIL] included in the print data signal SI is serially input in synchronization with the clock signal SCK, and is sequentially transferred in the shift register 212 corresponding to the ejection portion 600. When the input of the clock signal SCK is stopped, the 2-bit print data [SIH, SIL] corresponding to each of the m ejection portions 600 is held in each shift register 212. The print data [SIH, SIL] included in the print data signal SI is input in the order corresponding to the m-th stage, . . . , second stage, and first stage ejection portion 600 of the shift register 212.

When the latch signal LAT rises, each of the latch circuits 214 latches the 2-bit print data [SIH, SIL] held in the shift register 212 all at once. In FIG. 7, LT1, LT2, . . . , LTm represent 2-bit print data [SIH, SIL] latched by the latch circuit 214 corresponding to the shift register 212 of the first stage, the second stage, . . . , and the m-th stage.

The decoder 216 outputs the logic levels of the selection signals S1 and S2 as the contents shown in FIG. 5 in each of the periods T1 and T2 depending on the dot size defined by the latched 2-bit print data [SIH, SIL].

Specifically, when the input print data [SIH, SIL] is [1,1], the decoder 216 sets the selection signal S1 to H and H levels in the period T1 and T2, and sets the selection signal S2 to L and L levels in the period T1 and T2. In this case, the selection circuit 230 selects the trapezoidal waveform Adp1 in the period T1 and selects the trapezoidal waveform Adp2 in the period T2. As a result, the drive signal VOUT corresponding to the large dot LD shown in FIG. 3 is generated.

When the input print data [SIH, SIL] is [1,0], the decoder 216 sets the selection signal S1 to H and L levels in the period T1 and T2, and sets the selection signal S2 to L and H levels in the period T1 and T2. In this case, the selection circuit 230 selects the trapezoidal waveform Adp1 in the period T1 and selects the trapezoidal waveform Bdp2 in the period T2. As a result, the drive signal VOUT corresponding to the medium dot MD shown in FIG. 3 is generated.

When the input print data [SIH, SIL] is [0,1], the decoder 216 sets the selection signal S1 to H and L levels in the period T1 and T2, and sets the selection signal S2 to L and L levels in the period T1 and T2. In this case, the selection circuit 230 selects the trapezoidal waveform Adp1 in the period T1 and does not select either the trapezoidal waveform Adp2 or Bdp2 in the period T2. As a result, the drive signal VOUT corresponding to the small dot SD shown in FIG. 3 is generated.

When the input print data [SIH, SIL] is [0,0], the decoder 216 sets the selection signal S1 to L and L levels in the period T1 and T2, and sets the selection signal S2 to H and L levels in the period T1 and T2. In this case, the selection circuit 230 selects the trapezoidal waveform Bdp1 in the period T1 and does not select either the trapezoidal waveform Adp2 or Bdp2 in the period T2. As a result, the drive signal VOUT corresponding to the non-recording ND shown in FIG. 3 is generated.

As described above, the drive signal selection circuit 200 selects the waveforms of the drive signals COMA and COMB based on the print data signal SI, the latch signal LAT, the change signal CH, and the clock signal SCK, and outputs the waveforms as the drive signal VOUT. Then, the drive signal selection circuit 200 selects or does not select the waveforms of the drive signals COMA and COMB, thereby controlling the size of the dots formed on the medium, and as a result, in the liquid ejecting apparatus 1, dots of a desired size are formed on the medium.

3. Structure of Liquid Ejecting Apparatus

Figure 8:
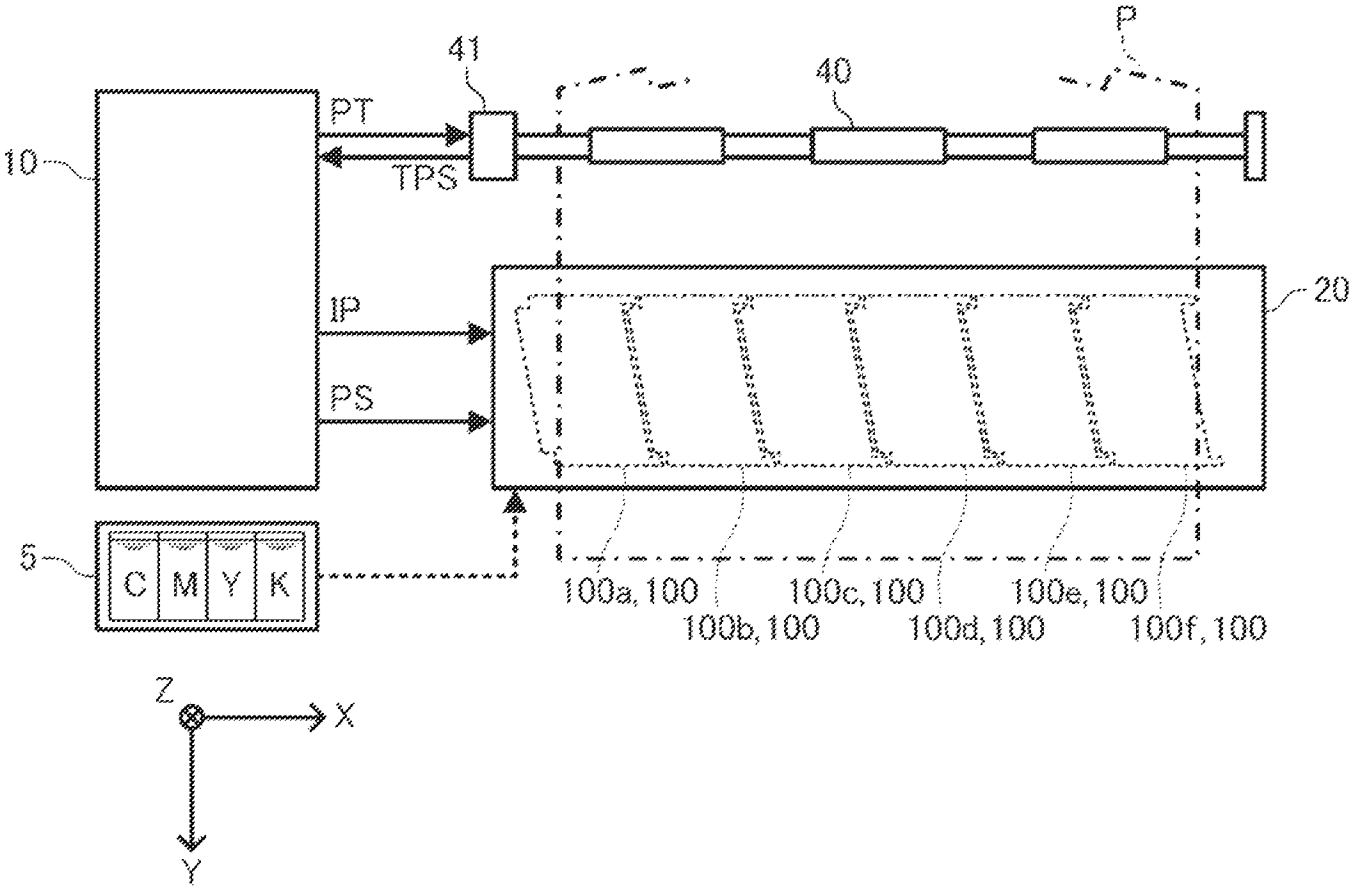
FIG. 8 is a diagram showing a schematic structure of the liquid ejecting apparatus.

Next, the schematic structure of the liquid ejecting apparatus 1 will be described. FIG. 8 is a diagram showing a schematic structure of the liquid ejecting apparatus 1. FIG. 8 shows arrows indicating the X direction, the Y direction, and the Z direction that are orthogonal to each other. The Y direction corresponds to the transport direction in which the medium P is transported, the X direction is a direction orthogonal to the Y direction and parallel to the horizontal plane and corresponds to the main scanning direction, and the Z direction is the up-and-down direction of the liquid ejecting apparatus 1 and corresponds to the vertical direction when the liquid ejecting apparatus 1 is installed. Here, in the following description, when the orientations of the X direction, the Y direction, and the Z direction are specified, in some cases, the tip end side of the arrow indicating the X direction is referred to as a+X side, and the starting point side thereof is referred to as a−X side, the tip end side of the arrow indicating the Y direction is referred to as a+Y side, and the starting point side thereof is referred to as a−Y side, and the tip end side of the arrow indicating the Z direction is referred to as a+Z side, and the starting point side thereof is referred to as a−Z side.

As shown in FIG. 8, the liquid ejecting apparatus 1 includes a liquid container 5 for storing ink in addition to the control unit 10, the head unit 20, and the transport unit 40 described above.

As described above, the control unit 10 includes the main control circuit 11 and the power supply circuit 12, and controls the operation of the liquid ejecting apparatus 1 including the head unit 20. Further, the control unit 10 may include an interface circuit or the like for communicating with a storage circuit for storing various information of the liquid ejecting apparatus 1, a host computer provided outside the liquid ejecting apparatus 1, and the like, in addition to the main control circuit 11 and the power supply circuit 12.

The control unit 10 receives an image signal input from an external device such as a host computer provided outside the liquid ejecting apparatus 1, and generates a transport control signal PT for controlling the transport of the medium P based on the received image signal and outputs the transport control signal to the transport unit 40. The transport unit 40 transports the medium P along the Y direction based on the transport control signal PT input from the control unit 10. Such a transport unit 40 includes a roller (not shown) for transporting the medium P, a motor for rotating the roller, and the like.

Further, the transport unit 40 has the position information detector 41. The position information detector 41 includes an encoder that detects the rotation angle of a roller that rotates for transporting the medium P to be transported, a position sensor that detects whether or not the medium P has reached a predetermined position, and the like. The position information detector 41 generates the transport position information signal TPS indicating the transport position of the medium P detected by the position information detector 41 including the encoder and the position sensor, and outputs the transport position information signal to the control unit 10. The control unit 10 generates the transport control signal PT based on the input transport position information signal TPS, and outputs the transfer control signal to the head unit 20.

The liquid container 5 stores ink to be ejected to the medium P. Specifically, the liquid container 5 includes four containers in which four color inks of cyan C, magenta M, yellow Y, and black K are individually stored. The ink stored in the liquid container 5 is supplied to the head unit 20 via a tube (not shown) or the like. The container in which the ink contained in the liquid container 5 is stored is not limited to four, and may include a container in which inks of colors other than cyan C, magenta M, yellow Y, and black K are stored, and include a plurality of containers of any one of cyan C, magenta M, yellow Y, and black K.

The head unit 20 includes ejection heads 100*a* to 100*f* arranged side by side in the X direction. The ejection heads 100*a* to 100*f* included in the head unit 20 are arranged side by side in the order of the ejection head 100*a*, the ejection head 100*b*, and the ejection head 100*c*, the ejection head 100*d*, the ejection head 100*e*, and the ejection head 100*f* from the −X side to the +X side so as to be equal to or larger than the width of the medium P along the X direction. The head unit 20 distributes the ink supplied from the liquid container 5 to each of the ejection heads 100*a* to 100*f*, and operates based on the image information signal IP and the position information signal PS input from the control unit 10. Thus, the ink supplied from the liquid container 5 is ejected from each of the ejection heads 100*a* to 100*f* to a desired position of the medium P. The number of ejection heads 100 included in the head unit 20 is not limited to 6, and may be 5 or less, or 7 or more.

As described above, in the liquid ejecting apparatus 1, the control unit 10 generates an image information signal IP based on an image signal input from a host computer or the like and a position information signal PS based on the transport position of the medium. Then, the control unit 10 controls the operation of the head unit 20 based on the generated image information signal IP and position information signal PS. Thereby, the ink ejected by each of the ejection heads 100*a* to 100*f* lands at a desired position on the medium P. As a result, a desired image is formed on the medium P.

4. Structure of Head Unit

Figure 9:
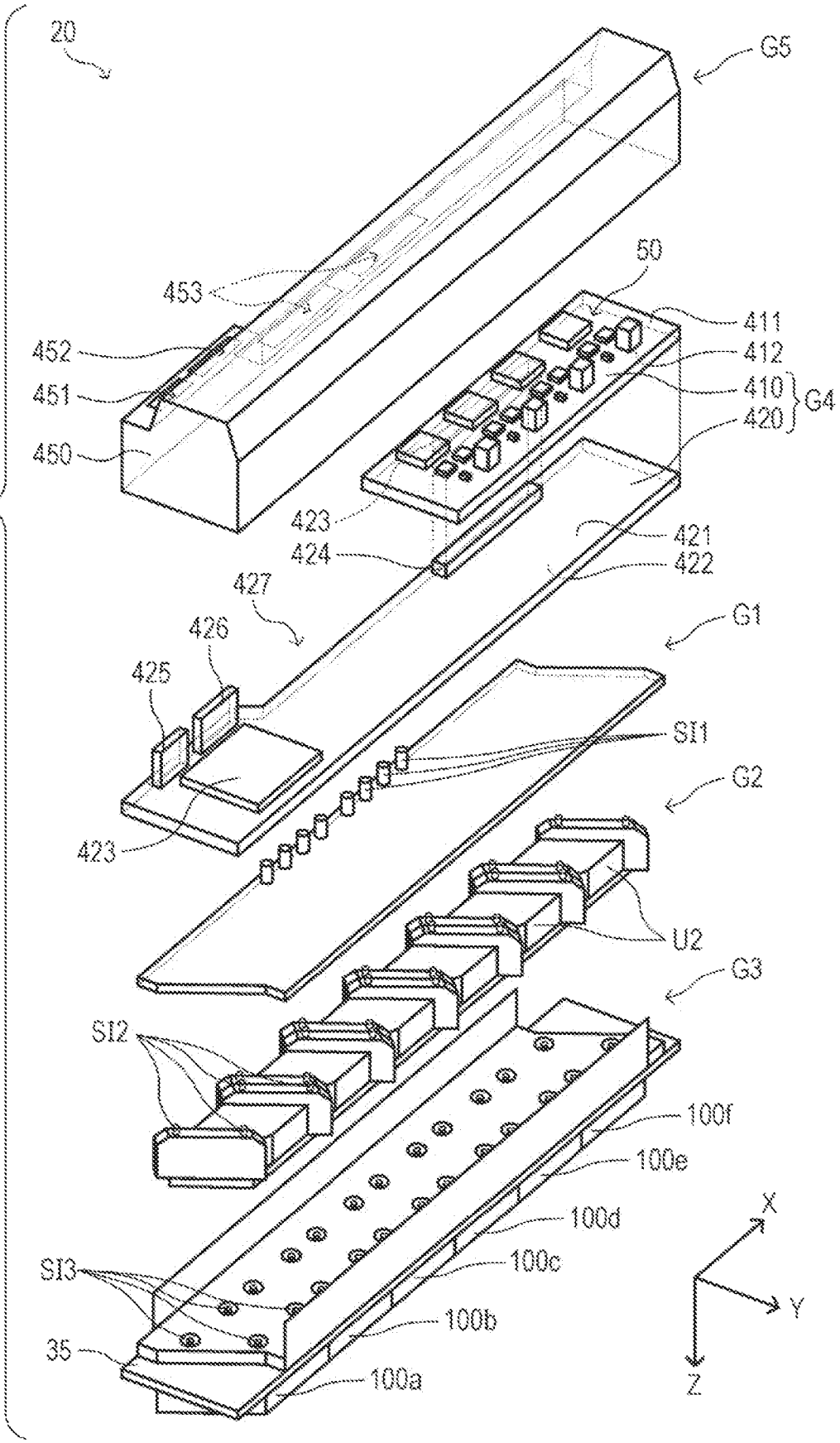
FIG. 9 is an exploded perspective view of a head unit when viewed from a−Z side.

Next, the structure of the head unit 20 will be described. FIG. 9 is an exploded perspective view of the head unit 20 when viewed from the −Z side. Further, FIG. 10 is an exploded perspective view of the head unit 20 when viewed from the +Z side.

Figure 10:
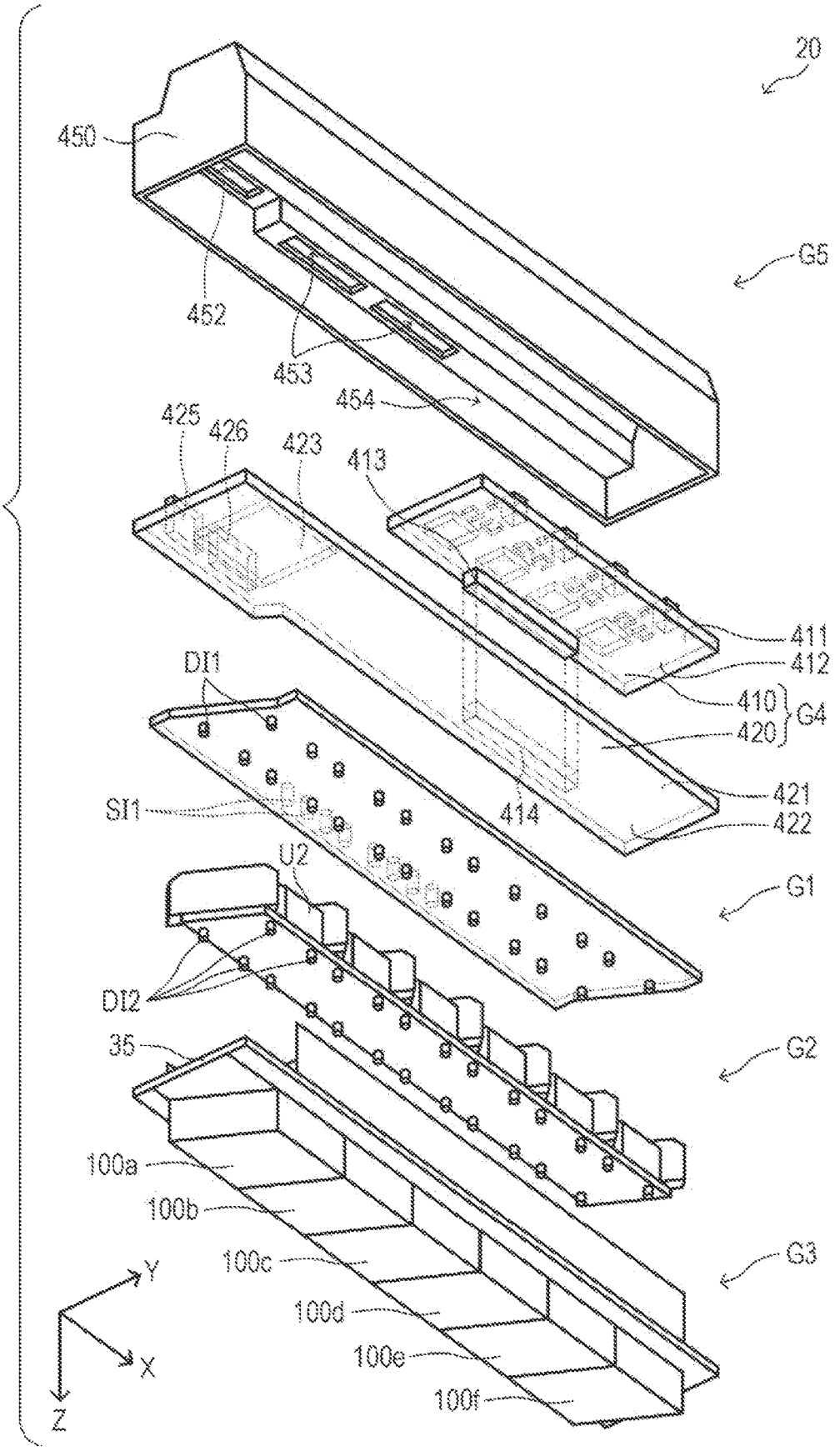
FIG. 10 is an exploded perspective view of the head unit when viewed from a+Z side.

As shown in FIGS. 9 and 10, the head unit 20 includes an introduction structure G1 that introduces ink supplied from the liquid container 5 into the inside of the head unit 20, a supply flow path portion G2 that introduces the introduced ink into the ejection head 100, a liquid ejection portion G3 having a plurality of ejection heads 100 for ejecting the ink, an ejection control portion G4 that controls the ejection of ink from the ejection head 100, and a head accommodating portion G5 that accommodates the introduction structure G1, the supply flow path portion G2, the liquid ejection portion G3, and the ejection control portion G4. Then, in the head unit 20, the introduction structure G1, the supply flow path portion G2, the liquid ejection portion G3, and the ejection control portion G4 are laminated in the order of the ejection control portion G4, the introduction structure G1, the supply flow path portion G2, and the liquid ejection portion G3 from the −Z side to the +Z side along the Z direction, and the head accommodating portion G5 is located so as to accommodate the laminated ejection control portion G4, the introduction structure G1, the supply flow path portion G2, and the liquid ejection portion G3. The introduction structure G1, the supply flow path portion G2, the liquid ejection portion G3, the ejection control portion G4, and the head accommodating portion G5 are fixed to each other by fixing means such as an adhesive or a screw (not shown).

As shown in FIGS. 9 and 10, the introduction structure G1 has a plurality of first introduction ports SI1 according to the number of types of ink supplied to the head unit 20, the number of ink types, and a plurality of first discharge ports DI1 according to the number of types of ink and the number of ejection heads 100 included in the head unit 20. Note that FIGS. 9 and 10 show a case where the introduction structure G1 has eight first introduction ports SI1 and 24 first discharge ports DI1.

Each of the first introduction ports SI1 is located side by side along the side of the −Y side of the introduction structure G1 on the −Z side surface of the introduction structure G1. A tube (not shown) or the like to which ink is supplied from the liquid container 5 shown in FIG. 8 is coupled to each of the first introduction ports SI1. Further, each of the first discharge ports DI1 is located on the +Z side surface of the introduction structure G1. An ink flow path that communicates any one of the first introduction ports SI1 and at least one of the first discharge ports DI1 is formed inside the introduction structure G1. Here, the first introduction port SI1 to which a tube or the like is coupled and the liquid is supplied from the liquid container 5 is an example of a liquid supply port.

The supply flow path portion G2 has a plurality of liquid supply units U2 according to the number of ejection heads 100 included in the head unit 20. Further, each of the plurality of liquid supply units U2 has a plurality of second introduction ports SI2 according to the number of types of ink supplied to the head unit 20, and a plurality of second discharge ports DI2 according to the number of types of ink supplied to the head unit 20. FIGS. 9 and 10 show the case where the supply flow path portion G2 has six liquid supply units U2, and each of the six liquid supply units U2 has four second introduction ports SI2 and four second discharge ports DI2.

Each of the second introduction ports SI2 is coupled to the plurality of first discharge ports DI1 of the introduction structure G1 located on the −Z side of the liquid supply unit U2. That is, the supply flow path portion G2 has a second introduction port SI2 corresponding to each of the first discharge ports DI1 of the introduction structure G1. Further, the second discharge port DI2 is located on the −Z side of the liquid supply unit U2. An ink flow path that communicates one second introduction port SI2 and one second discharge port DI2 is formed inside the liquid supply unit U2.

The liquid ejection portion G3 has ejection heads 100*a* to 100*f* and a support member 35. Each of the ejection heads 100*a* to 100*f* is located on the +Z side of the support member 35, and is fixed to the support member 35 by fixing means such as an adhesive or a screw (not shown). Further, the support member 35 is formed with openings corresponding to a plurality of third introduction ports SI3. Further, the plurality of third introduction ports SI3 are located on the −Z side of each of the six ejection heads 100*a* to 100*f*. By inserting the openings formed in the support member 35 through the plurality of third introduction ports SI3, the plurality of third introduction ports SI3 are exposed on the −Z side of the liquid ejection portion G3. Each of the third introduction ports SI3 is coupled to the second discharge port DI2 of the supply flow path portion G2. That is, the liquid ejection portion G3 has a third introduction port SI3 corresponding to each of the second discharge ports DI2 of the supply flow path portion G2.

Here, the flow until the ink stored in the liquid container 5 is supplied to the ejection head 100 of the head unit 20 will be described. The ink stored in the liquid container 5 is supplied to the first introduction port SI1 of the introduction structure G1 via a tube (not shown) or the like. The ink supplied to the first introduction port SI1 is distributed by an ink flow path (not shown) provided inside the introduction structure G1, and then supplied to the second introduction port SI2 of the liquid supply unit U2 via the first discharge port DI1. Then, the ink supplied to the second introduction port SI2 is supplied to the third introduction port SI3 of each of the six ejection heads 100 included in the liquid ejection portion G3 via the ink flow path provided inside the liquid supply unit U2 and the second discharge port DI2. That is, the introduction structure G1 and the liquid supply unit U2 function as a distribution flow path member that distributes and supplies the ink supplied to the head unit 20 from the first discharge port DI1 to each of the plurality of ejection heads 100 included in the head unit 20.

Figure 11:
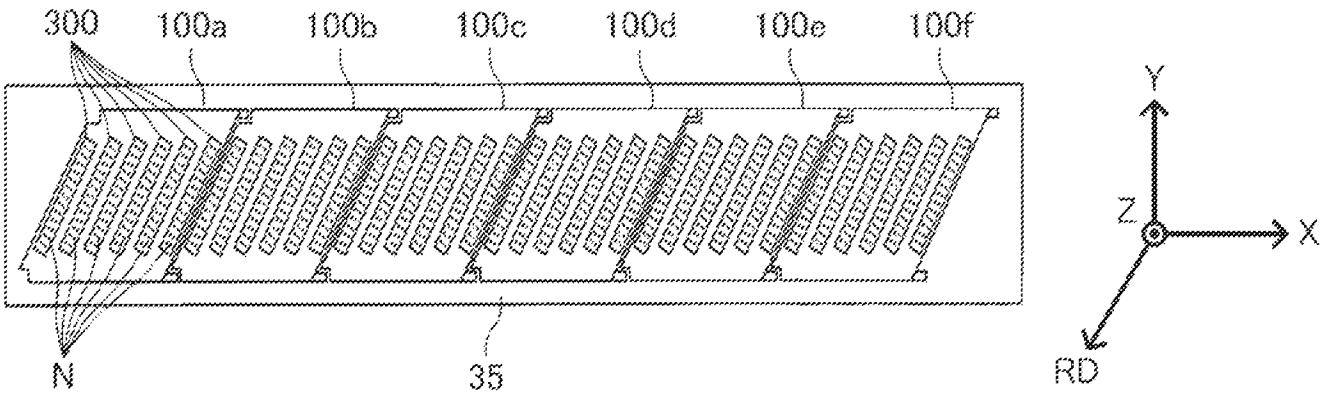
FIG. 11 is a view of the head unit when viewed from the +Z side.

Here, an example of the arrangement of the ejection heads 100*a* to 100*f* of the head unit 20 in the head unit 20 will be described. FIG. 11 is a view of the head unit 20 when viewed from the +Z side. As shown in FIG. 11, each of the ejection heads 100*a* to 100*f* of the head unit 20 has six head chips 300 arranged side by side in the X direction. Further, each head chip 300 has a plurality of nozzles N for ejecting the supplied ink to the medium P. The plurality of nozzles N included in each of the head chips 300 are arranged side by side along a row direction RD in a plane perpendicular to the Z direction and formed by the X direction and the Y direction. In the following description, a plurality of nozzles N arranged side by side along the row direction RD may be referred to as a nozzle row. The number of head chips 300 included in each of the ejection heads 100*a* to 100*f* is not limited to six.

Figure 12:
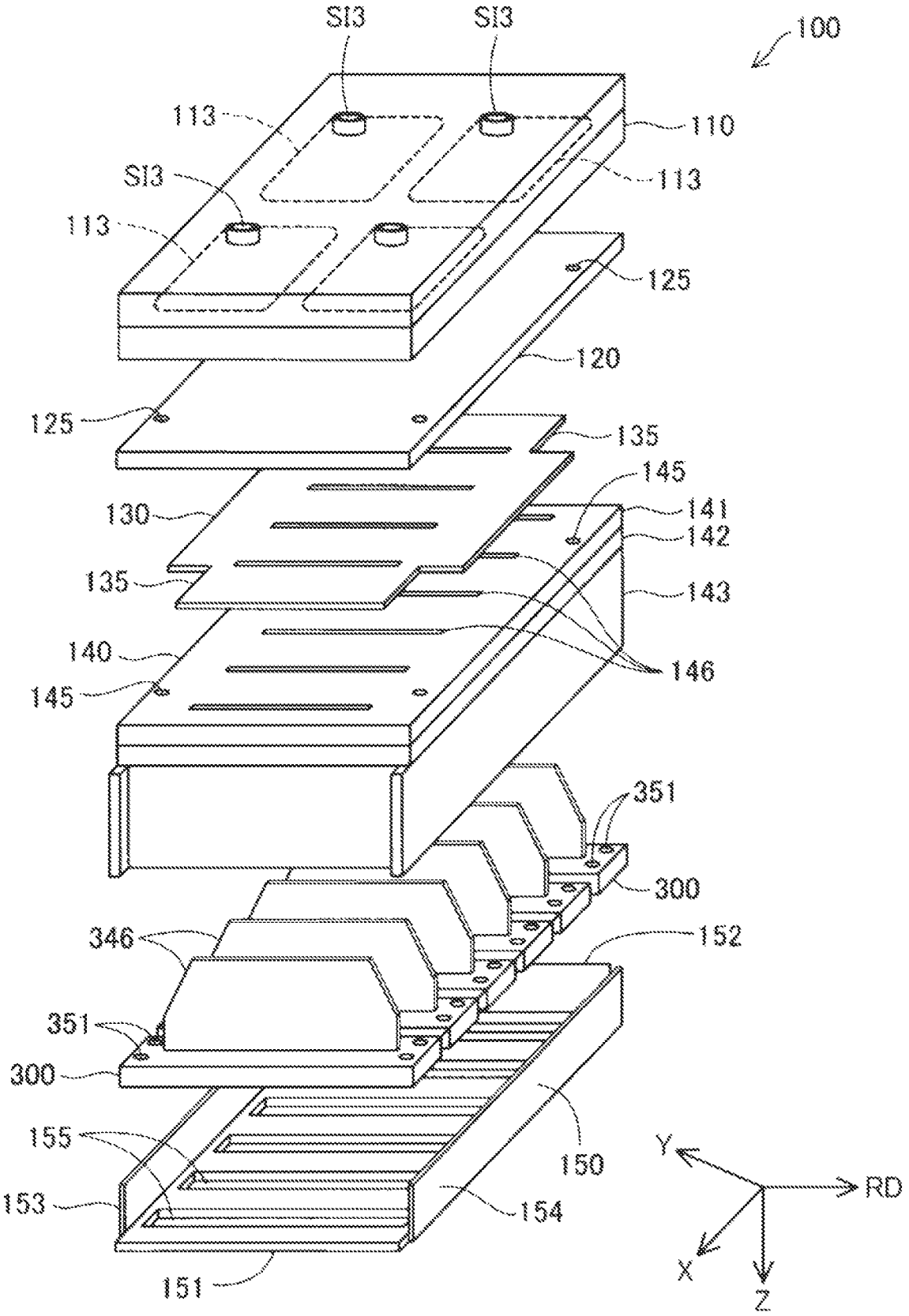
FIG. 12 is an exploded perspective view showing a schematic configuration of an ejection head.

Next, an example of the structure of the ejection head 100 will be described. FIG. 12 is an exploded perspective view showing a schematic configuration of the ejection head 100. As shown in FIG. 12, the ejection head 100 includes a filter portion 110, a seal member 120, a wiring substrate 130, a holder 140, six head chips 300, and a fixing plate 150. The ejection head 100 is configured by superimposing the filter portion 110, the seal member 120, the wiring substrate 130, the holder 140, and the fixing plate 150 in this order from the −Z side to the +Z side along the Z direction, and six head chips 300 are accommodated between the holder 140 and the fixing plate 150.

The filter portion 110 has a substantially parallelogram shape in which two opposite sides extend along the X direction and two opposite sides extend along the row direction RD. The filter portion 110 includes four filters 113 and four third introduction ports SI3. The four third introduction ports SI3 are located on the −Z side of the filter portion 110 and are provided corresponding to the four filters 113 located inside the filter portion 110. The filter 113 collects air bubbles and foreign substances contained in the ink supplied from the third introduction port SI3.

The seal member 120 is located on the +Z side of the filter portion 110, and has a substantially parallelogram shape in which two opposite sides extend along the X direction and two opposite sides extend along the row direction RD. Through-holes 125 through which the ink supplied from the filter portion 110 flows are provided at the four corners of the seal member 120. Such a seal member 120 is formed of, for example, an elastic member such as rubber. The seal member 120 is provided on the +Z side surface of the filter portion 110, and allows liquid-tight communication between a liquid discharge port (not shown) that communicates with the third introduction port SI3 via the filter 113, and a liquid introduction port 145 of the holder 140, which will be described later.

The wiring substrate 130 is located on the +Z side of the seal member 120, and has a substantially parallelogram shape in which two opposite sides extend along the X direction and two opposite sides extend along the row direction RD. Further, notches 135 provided so as not to block the through-holes 125 of the seal member 120 are formed at the four corners of the wiring substrate 130. The wiring substrate 130 is formed with wiring for propagating various signals such as the drive signals COMA and COMB and the voltage VHV supplied to the ejection head 100 to the head chip 300.

The holder 140 is located on the +Z side of the wiring substrate 130, and has a substantially parallelogram shape in which two opposite sides extend along the X direction and two opposite sides extend along the row direction RD. The holder 140 has a first holder member 141, a second holder member 142, and a third holder member 143. The first holder member 141, the second holder member 142, and the third holder member 143 are laminated in the order of the first holder member 141, the second holder member 142, and the third holder member 143 from the −Z side to the +Z side along the Z direction. Further, the space between the first holder member 141 and the second holder member 142 and the space between the second holder member 142 and the third holder member 143 are adhered with an adhesive or the like.

Further, inside the third holder member 143, an opening (not shown) is formed on the +Z side. An opening (not shown) formed in the third holder member 143 functions as an accommodation space for accommodating the head chip 300. Here, the accommodation space formed inside the third holder member 143 may be a plurality of spaces capable of individually accommodating each of the six head chips 300, and may be one space capable of accommodating six head chips 300 in common. Further, the holder 140 is provided with slit holes 146 corresponding to each of the six head chips 300. A flexible wiring substrate 346 for propagating various signals such as the drive signals COMA and COMB and the voltage VHV to the head chip 300 is inserted into the slit hole 146. The six head chips 300 accommodated in the accommodation space formed inside the third holder member 143 are fixed to the holder 140 with an adhesive or the like.

Further, four liquid introduction ports 145 are provided at the four corners of the upper surface of the holder 140. Each of the liquid introduction ports 145 is coupled to the through-hole 125 provided in the seal member 120. Thereby, the ink supplied from the third introduction port SI3 is supplied to the liquid introduction port 145. Then, the ink supplied to the liquid introduction port 145 is distributed corresponding to the six head chips 300 and then supplied to the six head chips 300.

The fixing plate 150 is located on the +Z side of the holder 140 and seals the accommodation space formed inside the third holder member 143 in which the six head chips 300 are accommodated. The fixing plate 150 has a flat surface portion 151, a first bent portion 152, a second bent portion 153, and a third bent portion 154. The flat surface portion 151 has a substantially parallelogram shape in which two opposite sides extend along the X direction and two opposite sides extend along the row direction RD. The flat surface portion 151 is formed with six openings 155 for exposing the head chip 300. The head chip 300 is fixed to the fixing plate 150 so that two rows of nozzle rows are exposed to the flat surface portion 151 via the opening 155.

The first bent portion 152 is a member that is coupled to one side extending along the X direction of the flat surface portion 151 and is integrated with the flat surface portion 151 bent to the −Z side, the second bent portion 153 is a member that is coupled to one side extending along the row direction RD of the flat surface portion 151 and is integrated with the flat surface portion 151 bent to the −Z side, and the third bent portion 154 is a member that is coupled to the other side extending along the row direction RD of the flat surface portion 151 and is integrated with the flat surface portion 151 bent to the −Z side.

The head chip 300 is located on the +Z side of the holder 140 and on the −Z side of the fixing plate 150. The head chip 300 is accommodated in the accommodation space formed by the third holder member 143 of the holder 140 and the fixing plate 150, and is fixed to the third holder member 143 and the fixing plate 150.

Figures 13, 14:
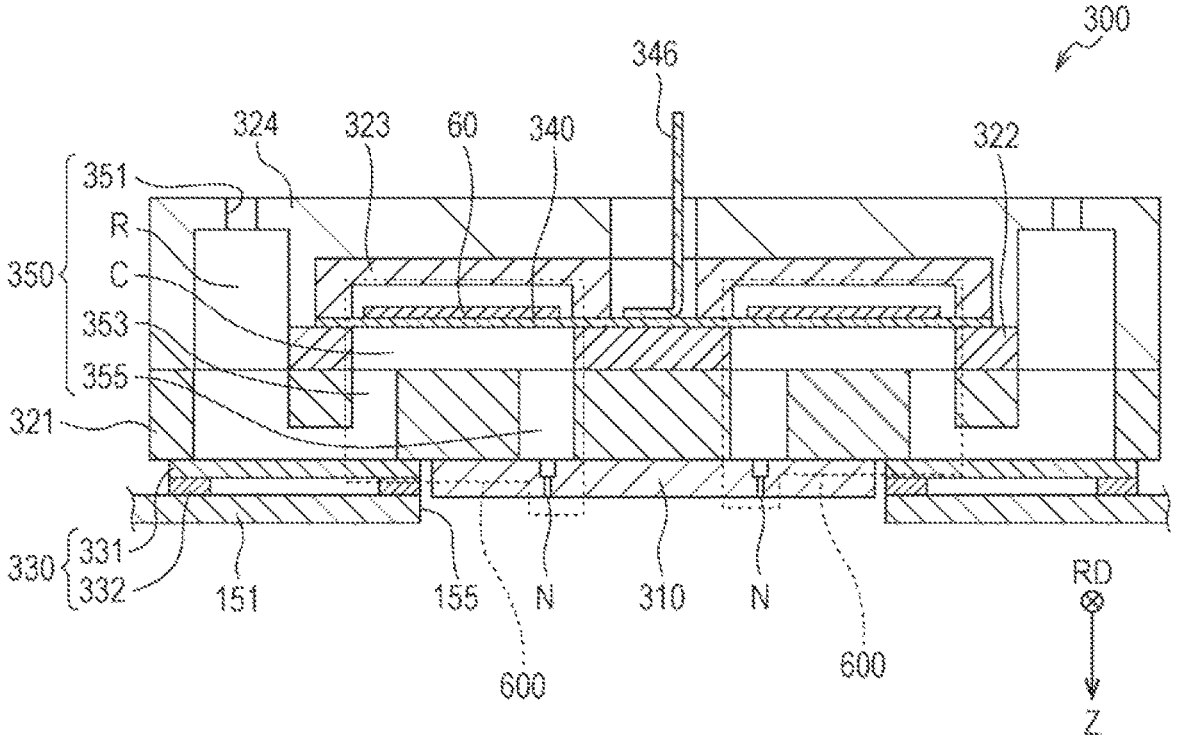
FIG. 13 is a cross-sectional view showing a schematic structure of a head chip.
FIG. 14 is a diagram showing an example of signals propagating at terminals included in a connector.

Here, an example of the structure of the head chip 300 will be described. FIG. 13 is a cross-sectional view showing a schematic structure of the head chip 300. The cross-sectional view shown in FIG. 13 shows a case where the head chip 300 is cut in a direction perpendicular to the row direction RD so as to include at least one nozzle N. As shown in FIG. 13, the head chip 300 has a nozzle plate 310 provided with a plurality of nozzles N that eject ink, a flow path forming substrate 321 that defines a communication flow path 355, an individual flow path 353, and a reservoir R, a pressure chamber substrate 322 that defines a pressure chamber C, a protective substrate 323, a compliance portion 330, a diaphragm 340, a piezoelectric element 60, a flexible wiring substrate 346, and a case 324 that defines the reservoir R and the liquid introduction port 351. Ink is supplied to the head chip 300 from a liquid discharge port (not shown) provided in the holder 140 via the liquid introduction port 351.

The ink supplied to the head chip 300 reaches the nozzle N via the ink flow path 350 configured including the reservoir R, the individual flow path 353, the pressure chamber C, and the communication flow path 355. As the piezoelectric element 60 is driven, the ink is ejected from the nozzle N.

Specifically, the ink flow path 350 is configured by laminating a flow path forming substrate 321, a pressure chamber substrate 322, and a case 324 along the Z direction. The ink introduced into the case 324 from the liquid introduction port 351 is stored in the reservoir R. The reservoir R is a common flow path communicating with a plurality of individual flow paths 353 corresponding to each of the plurality of nozzles N constituting the nozzle row. The ink stored in the reservoir R is supplied to the pressure chamber C via the individual flow path 353.

The pressure chamber C applies pressure to the stored ink to eject the ink supplied to the pressure chamber C from the nozzle N via the communication flow path 355. The diaphragm 340 is located on the −Z side of the pressure chamber C so as to seal the pressure chamber C, and the piezoelectric element 60 is located on the −Z side of the diaphragm 340. The piezoelectric element 60 is constituted by a piezoelectric body and a pair of electrodes formed on both sides of the piezoelectric body. When the drive signal VOUT is supplied to one of the pair of electrodes of the piezoelectric element 60 and the reference voltage signal VBS is supplied to the other of the pair of electrodes of the piezoelectric element 60, the piezoelectric body is displaced by the potential difference generated between the pair of electrodes, and as a result, the piezoelectric element 60 including the piezoelectric body is driven. As the piezoelectric element 60 is driven, the diaphragm 340 provided with the piezoelectric element 60 is deformed, so that the internal pressure of the pressure chamber C changes. As a result, the ink stored in the pressure chamber C is ejected from the nozzle N via the communication flow path 355.

Further, the nozzle plate 310 and the compliance portion 330 are fixed to the +Z side of the flow path forming substrate 321. The nozzle plate 310 is located on the +Z side of the communication flow path 355. A plurality of nozzles N are arranged side by side on the nozzle plate 310 along the row direction RD. The compliance portion 330 is located on the +Z side of the reservoir R and the individual flow path 353, and includes a sealing film 331 and a support 332. The sealing film 331 is a flexible film-like member, and seals the +Z side of the reservoir R and the individual flow path 353. The outer peripheral edge of the sealing film 331 is supported by a frame-shaped support 332. Further, the +Z side of the support 332 is fixed to the flat surface portion 151 of the fixing plate 150. The compliance portion 330 configured as described above protects the head chip 300 and reduces ink pressure fluctuations inside the reservoir R and inside the individual flow path 353.

Here, the configuration including the piezoelectric element 60, the diaphragm 340, the nozzle N, the individual flow path 353, the pressure chamber C, and the communication flow path 355 corresponds to the ejection portion 600 described above.

Referring back to FIG. 12, the ejection head 100 distributes the ink supplied from the liquid container 5 to the plurality of nozzles N, and ejects ink from the nozzle N by driving the drive signal VOUT supplied via the flexible wiring substrate 346 and the piezoelectric element 60 generated based on the reference voltage signal VBS. Here, the drive signal selection circuit 200 that outputs the drive signal VOUT may be provided on the wiring substrate 130, or may be provided on the flexible wiring substrate 346 corresponding to each of the head chips 300.

Referring back FIGS. 9 and 10, the ejection control portion G4 is located on the −Z side of the introduction structure G1 and includes the wiring substrate 410 and the wiring substrate 420.

The wiring substrate 410 includes a surface 411 and a surface 412 located on the opposite side of the surface 411, and a substantially rectangular shape in which two opposite sides extend along the X direction and two opposite sides extend along the Y direction. The wiring substrate 410 is arranged so that the surface 412 faces the side of the introduction structure G1, the supply flow path portion G2, and the liquid ejection portion G3, and the surface 411 faces the side opposite to the introduction structure G1, the supply flow path portion G2, and the liquid ejection portion G3. The drive signal output circuit 50 that outputs the drive signals COMA and COMB is provided on the surface 411 of the wiring substrate 410. Specifically, on the surface 411, four sets of class D amplifier circuits that output each of the drive signals COMA1, COMB1, COMA2, and COMB2 output by the drive signal output circuit 50 are arranged side by side along the X direction. In detail, the four sets of class D amplifier circuits are four sets of a semiconductor device that controls the operation of the class D amplifier circuit, a pair of transistors that amplify the signal output from the semiconductor device, and a coil and a capacitor that smooth the signal output to the midpoint of the pair of transistors.

Further, a connector 413 is provided on the surface 412 of the wiring substrate 410. The connector 413 propagates the drive signals COMA1, COMB1, COMA2, and COMB2 generated by the drive signal output circuit 50 output to the ejection head 100, and propagates a plurality of signals including the basic drive signals dA1, dB1, dA2, and dB2 which are the basis of the drive signals COMA1, COMA2, COMB1, and COMB2 output by the drive signal output circuit 50.

The wiring substrate 420 includes a surface 421 and a surface 422 located on the opposite side of the surface 421, and a substantially rectangular shape in which two opposite sides extend along the X direction and two opposite sides extend along the Y direction. Further, a notch 427 for passing the first introduction port SI1 of the introduction structure G1 is formed on the −Y side of the wiring substrate 420. The wiring substrate 420 is on the +Z side of the wiring substrate 410, and is provided so that the surface 421 faces the −Z side, which is the upper portion of the vertical direction, and the surface 422 faces the +Z side, which is the lower portion of the vertical direction, along the Z direction which is the vertical direction. That is, the wiring substrate 420 is located between the wiring substrate 410, the introduction structure G1, the supply flow path portion G2, and the liquid ejection portion G3.

As shown in FIGS. 9 and 10, a semiconductor device 423 and connectors 424, 425, and 426 are provided on the surface 421 of the wiring substrate 420.

The connector 424 is coupled to the connector 413 provided on the wiring substrate 410. As such a connector 424, a board to board (BtoB) connector that electrically coupled to the wiring substrate 410 and the wiring substrate 420 is used. The connector 424 is located in the +X side region of the wiring substrate 420 and along the side of the −Y side of the wiring substrate 420.

The semiconductor device 423 is a circuit component that constitutes at least a portion of the head control circuit 21 described above, and is composed of, for example, a SoC. The semiconductor device 423 is a region on the −X side of the wiring substrate 420 with respect to the connector 424, and is preferably provided at a position that does not overlap the wiring substrate 420 when the ejection control portion G4 is viewed from the −Z side to the +Z side.

The voltages VHV and VDD functioning as the power supply voltage of the head unit 20 and the position information signal PS indicating the transport position of the medium P are input to the connector 426. That is, the connector 426 has a plurality of terminals including a terminal to which the voltage VHV which is the power supply voltage of the head unit 20 is supplied, a terminal to which the voltage VDD which is the power supply voltage of the head unit 20 is supplied, and a terminal to which the position information signal PS indicating the transport position of the medium P is input. The connector 426 is arranged on the −Y side of the semiconductor device 423 and on the −X side of the notch 427 so that a plurality of terminals including a terminal to which the voltage VHV which is the power supply voltage of the head unit 20 is supplied, a terminal to which the voltage VDD which is the power supply voltage of the head unit 20 is supplied, and a terminal to which the position information signal PS indicating the transport position of the medium P is input are arranged along the X direction.

FIG. 14 is a diagram showing an example of signals propagating at terminals included in the connector 426. In FIG. 14, the terminals arranged along the X direction are referred to as terminals 426-1, 426-2, . . . , 426-7, and 426-8 in the order from the −X side to the +X side. As shown in FIG. 14, among the plurality of terminals included in the connector 426, a ground signal GND indicating the reference potential of the head unit 20 propagates to the terminal 426-1. Further, the voltage VDD which is the power supply voltage of the head unit 20 propagates to the terminal 426-2 located on the +X side of the terminal 426-1. Further, the ground signal GND indicating the reference potential of the head unit 20 propagates to the terminal 426-3 located on the +X side of the terminal 426-2. Further, the voltage VHV which is the power supply voltage of the head unit 20 propagates to the terminal 426-4 located on the +X side of the terminal 426-3.

Further, the position information signal PS indicating the transport position of the medium P propagates to the terminals 426-5 to 426-8 located on the +X side of the terminal 426-4. Specifically, as the position information signal PS, a pre-printing position information signal PS-pp indicating that the medium P has been transported to the ink ejection region propagates to the terminal 426-5 located on the +X side of the terminal 426-4, as the position information signal PS, a transport reference position information signal PS-bp indicating that the medium P transported by the transport unit 40 has reached a reference position for detecting the transport position by an encoder or the like propagates to the terminal 426-6 located on the +X side of the terminal 426-5, and transport position information signals PS-enc1 and PS-enc2, which are detected by an encoder or the like, indicating the transport position after the medium P reaches the reference position propagate to the terminals 426-7 and 426-8 located on the +X side of the terminal 426-6.

Here, among the plurality of terminals included in the connector 426, the terminal 426-4 to which the voltage VHV is supplied is an example of a second terminal, and the terminal 426-2 to which the voltage VDD is supplied is another example of a second terminal. Further, at least one of the terminal 426-5 through which the pre-printing position information signal PS-pp as the position information signal PS propagates, the terminal 426-6 through which the transport reference position information signal PS-bp propagates, the terminals 426-7 and 426-8 through which the transport position information signals PS-enc1 and PS-enc2 propagate is an example of a third terminal.

Referring back to FIGS. 9 and 10, the image information signal IP output by the control unit 10 is input to the connector 425. That is, the connector 425 has a plurality of terminals through which the input image information signal IP propagates. The connector 425 is arranged on the −Y side of the semiconductor device 423 and on the −X side of the connector 426 so that a plurality of terminals to which the image information signal IP is input are arranged along the X direction. That is, the connector 425 and the connector 426 are provided side by side so that the connector 425 is located on the −X side and the connector 426 is located on the +X side along the side of the −Y side of the wiring substrate 410.

Here, as described above, the image information signal IP input to the connector 425 is an electric signal such as a differential signal, which is a signal based on a communication standard for high-speed communication such as PCIe, for example. Therefore, the connector 425 and the cable coupled to the connector 425 preferably have a configuration capable of stably propagating a signal of several Gbps. For example, as the connector 425, it is preferable to use an high-definition multimedia interface (HDMI) (registered trademark) connector capable of propagating a high-speed signal based on such a HDMI communication standard suitable for high-speed communication or a high-speed transmission connector such as a universal serial bus (USB) connector capable of propagating a high-speed signal based on a USB communication standard, and the cable coupled to the connector 425 is preferably a high-speed transmission cable such as an HDMI cable capable of propagating a high-speed signal based on the HDMI communication standard or a USB cable capable of propagating a high-speed signal based on the USB communication standard. That is, the connector 425 is a high-speed transmission connector, and the image information signal IP propagates through a plurality of terminals included in the high-speed transmission connector.

As described above, by using a high-speed transmission connector such as an HDMI connector capable of propagating signals based on the HDMI communication standard and a USB connector capable of propagating signals based on the USB communication standard as the connector 425 to which the image information signal IP based on the PCIe communication standard is input, when a cable through which the image information signal IP propagates is attached to the connector 425, the influence of contact resistance and the like can be reduced. Further, by using a high-speed transmission connector such as an HDMI connector or a USB connector as the connector 425, a high-speed transmission cable such as an HDMI cable or a USB cable can also be used as a cable coupled to the connector 425 and propagating the image information signal IP. As a result, the possibility that noise is superimposed on the image information signal IP propagating through the cable is also reduced.

Further, by using an HDMI connector or a USB connector as the connector 425, the compatible HDMI cable or USB cable can be easily attached and detached, and the maintainability of the liquid ejecting apparatus 1 such as the replacement of the head unit 20 can be improved. That is, by using the high-speed transmission connector as the connector 425 to which the image information signal IP is input, the signal accuracy of the propagated image information signal IP and the maintainability of the head unit 20 are improved.

Further, since an HDMI connector has more terminals than the USB connector when the HDMI connector is used as the connector 425, the image information signal IP can propagate a plurality of differential signals in a parallel format, and the propagation speed can be further improved as compared with the case where a USB connector is used as the connector 425. On the other hand, since the terminal spacing of a USB connector is wider than the terminal spacing of an HDMI connector when the USB connector is used as the connector 425, even if the ink supplied from the liquid container 5 leaks in the vicinity of the first introduction port SI1 and adheres to the connector 425, the possibility that an abnormality such as a short circuit occurs between the terminals included in the connector 425 is reduced, and as a result, the possibility that the operational stability of the liquid ejecting apparatus 1 is lowered due to the ink adhering to the connector 425 is reduced. Here, among the plurality of terminals included in the connector 425, the terminal to which the image information signal IP is input is an example of a first terminal.

Here, in the present embodiment, although it has been described that the connector 426 includes a terminal to which the voltages VHV and VDD functioning as the power supply voltage of the head unit 20 and the position information signal PS indicating the transport position of the medium P are input, and the connector 425 includes a terminal to which the image information signal IP output by the control unit 10 is input, one connector may include a terminal to which the voltages VHV and VDD functioning as the power supply voltage of the head unit 20 and the position information signal PS indicating the transport position of the medium P are input, and a terminal to which the image information signal IP output by the control unit 10 is input.

However, as shown in the present embodiment, by assuming that different connectors include the terminal to which the voltages VHV and VDD functioning as the power supply voltage of the head unit 20 and the position information signal PS indicating the transport position of the medium P are input, and the terminal to which the image information signal IP output by the control unit 10 is input, the possibility that the image information signal IP based on the communication standard for high-speed communication such as PCIe, and the voltages VHV and VDD and the position information signal PS, which have a low communication speed as compared with the image information signal IP having a large voltage value, interfere with each other is reduced. As a result, the accuracy of various signals generated by the head unit 20 based on the image information signal IP, the voltage VHV and VDD, and the position information signal PS is improved, and the operational stability of the liquid ejecting apparatus 1 is further improved.

The head accommodating portion G5 includes a housing 450 in which opening holes 451, 452, and 453 are formed. The housing 450 has a substantially rectangular shape including a pair of long sides extending along the X direction and a pair of short sides extending along the Y direction when viewed along the Z direction, and is made of, for example, a metal such as aluminum or a resin. Further, an opening 454 is formed on the +Z side of the housing 450. The introduction structure G1, the supply flow path portion G2, the liquid ejection portion G3, and the ejection control portion G4 are accommodated in the opening 454. That is, the opening 454 functions as a main space for accommodating the introduction structure G1, the supply flow path portion G2, the liquid ejection portion G3, and the ejection control portion G4. The introduction structure G1, the supply flow path portion G2, the liquid ejection portion G3, and the ejection control portion G4 accommodated in the opening 454 are fixed to the housing 450 by fixing means such as an adhesive or a screw (not shown). Here, the opening 454 may be configured to be sealed by the support member 35 included in the liquid ejection portion G3 while accommodating the introduction structure G1, the supply flow path portion G2, and the liquid ejection portion G3.

The opening holes 451, 452, and 453 are located side by side in the order of the opening holes 451, the opening holes 452, and the opening holes 453 on the −Y side of the housing 450 from the −X side to the +X side along the X direction. The connector 425 of the ejection control portion G4 accommodated in the accommodation space is inserted into the opening hole 451. The connector 426 of the ejection control portion G4 accommodated in the accommodation space is inserted into the opening hole 452. Further, the first introduction port SI1 of the introduction structure G1 is inserted into the opening hole 453 after passing through the notch 427 of the wiring substrate 420. That is, the opening holes are openings for exposing the connectors 425 and 426 for propagating various signals to the first introduction port SI1 that supplies ink to the introduction structure G1, the supply flow path portion G2, and the liquid ejection portion G3 accommodated inside the housing 450, the liquid ejection portion G3, and the ejection control portion G4 to the outside of the head unit 20. Thereby, the introduction structure G1, the supply flow path portion G2, the liquid ejection portion G3, and the ejection control portion G4 are protected by the housing 450, and the head unit 20 can be easily replaced, so that the maintainability of the liquid ejecting apparatus 1 can be improved. Although FIGS. 9 and 10 show that there are two opening holes 453, the number of opening holes 453 may be one or three or more.

Figure 15:
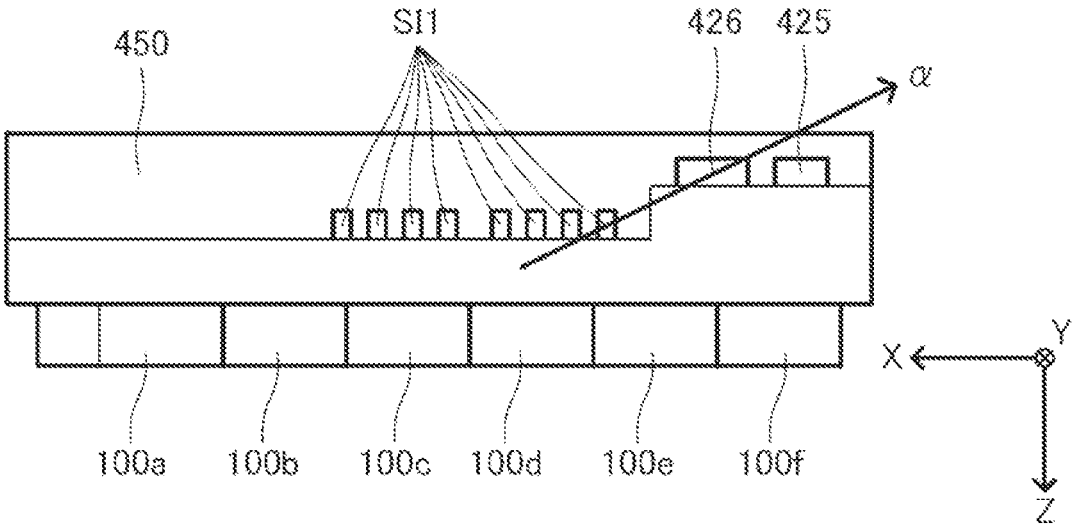
FIG. 15 is a side view of the head unit when viewed from a−Y side.
Figure 16:
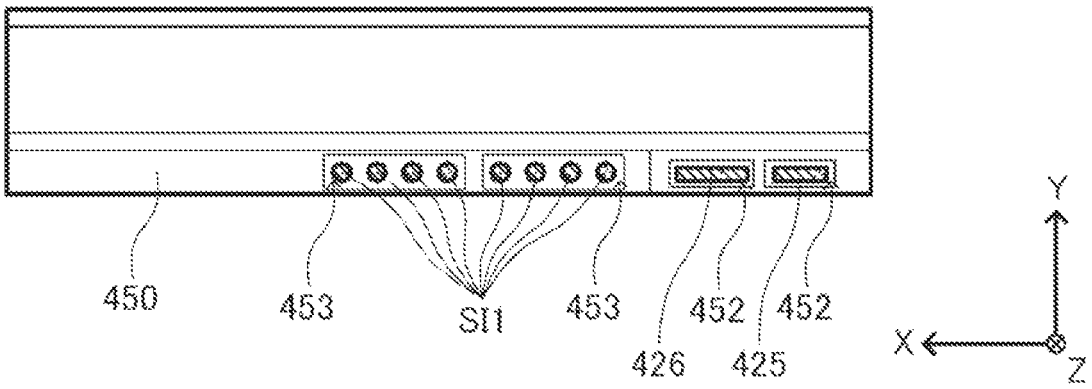
FIG. 16 is a top view of the head unit when viewed from the −Z side.

Here, the arrangement of the connector 425, the connector 426, and the first introduction port SI1 in the head unit 20 in the state of being accommodated in the housing 450 will be described with reference to FIGS. 15 and 16. FIG. 15 is a side view of the head unit 20 when viewed from the −Y side. FIG. 16 is a top view of the head unit 20 when viewed from the −Z side.

As shown in FIGS. 15 and 16, in the head unit 20, the connectors 425 and 426 and the first introduction port SI1 are one side extending in the X direction of the housing 450 and located on the −Y side, and are located side by side in the order of the connector 425, the connector 426, and the first introduction port SI1 from the −X side to the +X side along the long side located on the −Y side of the housing 450.

That is, the connector 426 including the terminal to which the voltages VHV and VDD functioning as the power supply voltage are supplied and the terminal to which the position information signal PS indicating the transport position of the medium P is input is located between the connector 425 including the terminal to which the image information signal IP is input and the first introduction port SI1 to which ink is supplied from the liquid container 5 when viewed from the Y direction intersecting the X direction.

The image information signal IP is an important signal for controlling the operation of the liquid ejecting apparatus 1, and has a very small voltage amplitude, particularly when the image information signal IP is a signal based on high-speed communication that enables transfer of several GHz. Therefore, in a case where the ink introduced from the liquid container 5 into the first introduction port SI1 leaks and adheres to the terminal included in the connector 425 through which the image information signal IP propagates, the possibility of malfunction of the liquid ejecting apparatus 1 increases as compared with the case where the ink introduced from the liquid container 5 into the first introduction port SI1 leaks and adheres to the terminal to which the voltages VHV and VDD functioning as the power supply voltage are supplied and the terminal to which the position information signal PS indicating the transport position of the medium P is input.

When the connector 426 including the terminal to which the voltages VHV and VDD functioning as the power supply voltage are supplied and the terminal to which the position information signal PS indicating the transport position of the medium P is input is located between the connector 425 including the terminal to which the image information signal IP is input and the first introduction port SI1 to which ink is supplied from the liquid container 5 when viewed from the Y direction intersecting the X direction, the connector 425 including the terminal to which the image information signal IP is input and the first introduction port SI1 to which ink is supplied from the liquid container 5 can be provided separately. As a result, even if the ink introduced into the first introduction port SI1 leaks from the liquid container 5, the possibility that the ink adheres to the connector 425 including the terminal to which the image information signal IP is input is reduced, and as a result, the possibility of malfunction of the liquid ejecting apparatus 1 is reduced.

Further, as shown in FIG. 15, the connectors 425 and 426 and the first introduction port SI1 are located so that a direction a shown in FIG. 15 in which the connector 426 and the first introduction port SI1 are arranged and the X direction in which the connector 425 and the connector 426 are arranged are different directions in the Z direction. Thereby, the connector 425 and the first introduction port SI1 can be provided further apart, and as a result, even if the ink introduced into the first introduction port SI1 leaks from the liquid container 5, the possibility that the ink adheres to the connector 425 including the terminal to which the image information signal IP is input is further reduced, and as a result, the possibility of malfunction of the liquid ejecting apparatus 1 is further reduced.

Further, as shown in FIG. 15, the first introduction port SI1 is located on the +Z side of the connector 425 and the connector 426 in the direction along the X direction in which the connector 425 and the connector 426 are arranged. In other words, in the Z direction, the connectors 425 and 426 are located vertically above the first introduction port SI1.

When ink introduced into the first introduction port SI1 leaks from the liquid container 5, the ink moves vertically downward due to the influence of gravity. Since the connectors are located vertically above the first introduction port SI1, even if the ink introduced into the first introduction port SI1 leaks from the liquid container 5, the possibility that the ink adheres to the connectors 425 and 426 is further reduced, and as a result, the possibility of malfunction of the liquid ejecting apparatus 1 is further reduced.

Here, the X direction in which the connector 425 and the connector 426 are arranged is an example of a first direction, the Y direction intersecting the X direction is an example of a second direction, and the direction a in which the connector 426 and the first introduction port SI1 are arranged is an example of a third direction.

5. Effect

As described above, in the liquid ejecting apparatus 1 according to the present embodiment, the head unit 20 has the connector 426 including the terminal to which the voltages VHV and VDD functioning as the power supply voltage are supplied and the terminal to which the position information signal PS indicating the transport position of the medium P is input, and the first introduction port SI1 to which ink is supplied from the liquid container 5, and when the connector 426 including the terminal to which the voltages VHV and VDD functioning as the power supply voltage are supplied and the terminal to which the position information signal PS indicating the transport position of the medium P is input is viewed from the Y direction intersecting the X direction, the connector 426 is located between the connector 425 and the first introduction port SI1. Thereby, the connector 425 including the terminal to which the image information signal IP having a high frequency and a small voltage amplitude, which is a signal required for controlling the liquid ejecting apparatus 1, is input and the first introduction port SI1 to which ink is supplied from the liquid container 5 can be provided separately. As a result, even if the ink introduced into the first introduction port SI1 leaks from the liquid container 5, the possibility that the ink adheres to the connector 425 including the terminal to which the image information signal IP is input is reduced. Therefore, even if the ink introduced into the first introduction port SI1 leaks from the liquid container 5, the possibility of malfunction of the liquid ejecting apparatus 1 due to the leaked ink is reduced.

The embodiments have been described above, but the present disclosure is not limited to these embodiments and can be carried out in various modes without departing from the scope of the present disclosure. For example, it is possible to combine the above-described embodiments as appropriate.

The present disclosure includes configurations that are substantially the same as the configurations described in the embodiments (for example, configurations having the same function, method, and result, or configurations having the same object and effect). Further, the present disclosure includes configurations in which non-essential parts of the configurations described in the embodiments are replaced. In addition, the present disclosure includes configurations that achieve the same effect as the configurations described in the embodiments or configurations that can achieve the same object. Further, the present disclosure includes configurations in which known techniques are added to the configurations described in the embodiments.

The following contents are derived from the above-described embodiment.

According to an aspect, there is provided a liquid ejecting apparatus including a head unit that includes a nozzle that ejects a liquid, a control circuit that outputs a control signal that controls an operation of the head unit, a power supply circuit that supplies a power supply voltage to the head unit, and a liquid container that stores the liquid, in which the head unit includes a first terminal to which the control signal is input, a second terminal to which the power supply voltage is supplied, and a liquid supply port to which the liquid is supplied, in which the first terminal and the second terminal are located side by side along a first direction, and the second terminal is located between the first terminal and the liquid supply port in a second direction intersecting the first direction.

According to the liquid ejecting apparatus, since a second terminal to which a power supply voltage is supplied are located between a first terminal to which a control signal is input and a liquid supply port to which the liquid is supplied, the first terminal to which the control signal is input and the liquid supply port to which the liquid is supplied can be provided separately. As a result, even if ink leaks from the liquid supply port to which the liquid is supplied, the possibility that the leaked ink adheres to the first terminal to which the control signal is input can be reduced, and the possibility that the operational stability of the liquid ejecting apparatus is lowered can be reduced.

In the liquid ejecting apparatus according to the aspect, the second terminal and the liquid supply port may be located side by side along the first direction and a third direction different from the second direction.

According to the liquid ejecting apparatus, the first terminal to which the control signal is input and the liquid supply port to which the liquid is supplied can be further provided separately. As a result, even if ink leaks from the liquid supply port to which the liquid is supplied, the possibility that the leaked ink adheres to the first terminal to which the control signal is input can be further reduced, and the possibility that the operational stability of the liquid ejecting apparatus is lowered can be further reduced.

In the liquid ejecting apparatus according to the aspect, the first terminal may be located vertically above the liquid supply port.

When ink leaks from the liquid supply port to which the liquid is supplied, the leaked ink moves vertically downward due to the gravity. According to the liquid ejecting apparatus, since the first terminal to which the control signal is input is located vertically above the liquid supply port to which the liquid is supplied, even if ink leaks from the liquid supply port to which the liquid is supplied, the possibility that the leaked ink adheres to the first terminal to which the control signal is input can be further reduced, and the possibility that the operational stability of the liquid ejecting apparatus is lowered can be further reduced.

The liquid ejecting apparatus according to the aspect may further include a position information detector that outputs a position information signal based on a relative positional relationship between the head unit and a medium on which the liquid is ejected, the head unit may include a third terminal to which the position information signal is input, and the third terminal may be located between the first terminal and the liquid supply port in the second direction.

According to the liquid ejecting apparatus, since the third terminal to which the position information signal is input is located in addition the second terminal to which the power supply voltage is supplied between the first terminal to which the control signal is input and the liquid supply port to which the liquid is supplied, the first terminal to which the control signal is input and the liquid supply port to which the liquid is supplied can be further provided separately. As a result, even if ink leaks from the liquid supply port to which the liquid is supplied, the possibility that the leaked ink adheres to the first terminal to which the control signal is input can be further reduced, and the possibility that the operational stability of the liquid ejecting apparatus is lowered can be further reduced.

In the liquid ejecting apparatus according to the aspect, the head unit may include a housing, and the first terminal, the second terminal, and the liquid supply port may be located side by side along one side of the housing.

According to the liquid ejecting apparatus, since the first terminal to which the control signal is input, the second terminal to which the power supply voltage is supplied, and the liquid supply port to which the liquid is supplied are arranged along one side of a housing, workability when removing the head unit can be improved in maintenance and the like. That is, the maintainability of the liquid ejecting apparatus can be improved.

In the liquid ejecting apparatus according to the aspect, the first terminal, the second terminal, and the liquid supply port may be located side by side along a long side of the housing.

According to the liquid ejecting apparatus, since the first terminal to which the control signal is input, the second terminal to which the power supply voltage is supplied, and the liquid supply port to which the liquid is supplied are arranged along the long side of the housing, workability when removing the head unit can be improved in maintenance and the like and the distance between the first terminal to which the control signal is input, the second terminal to which the power supply voltage is supplied, and the liquid supply port to which the liquid is supplied can be widened. Thereby, even if ink leaks from the liquid supply port to which the liquid is supplied, the possibility that the leaked ink adheres to the first terminal to which the control signal is input is further reduced. That is, the maintainability of the liquid ejecting apparatus can be improved, the possibility that the leaked ink adheres to the first terminal to which the control signal is input can be further reduced, and the possibility that the operational stability of the liquid ejecting apparatus is lowered can be further reduced.

In the liquid ejecting apparatus according to the aspect, the first terminal and the second terminal may be provided on different connectors.

According to the liquid ejecting apparatus, the distance between the first terminal to which the control signal is input and the second terminal to which the power supply voltage is supplied can be widened, and therefore, the distance between the first terminal to which the control signal is input and the liquid supply port to which the liquid is supplied can be widened. Therefore, the possibility that the leaked ink adheres to the first terminal to which the control signal is input can be further reduced, and the possibility that the operational stability of the liquid ejecting apparatus is lowered can be further reduced.

In the liquid ejecting apparatus according to the aspect, the first terminal may be provided on a high-speed transmission connector.

In the liquid ejecting apparatus according to the aspect, the high-speed transmission connector may be a USB connector.

According to the liquid ejecting apparatus, a USB connector including the first terminal to which the control signal is input and a cable attached to the USB connector can be easily attached and detached, and as a result, the maintainability of the liquid ejecting apparatus can be further improved.

According to an aspect, there is provided a head unit including a first terminal to which a control signal is input, a second terminal to which a power supply voltage is supplied, and a liquid supply port to which the liquid is supplied, in which the second terminal is located between the first terminal and the liquid supply port in a second direction intersecting a first direction in which the first terminal and the second terminal are arranged.

According to the head unit, since a second terminal to which a power supply voltage is supplied are located between a first terminal to which a control signal is input and a liquid supply port to which the liquid is supplied, the first terminal to which the control signal is input and the liquid supply port to which the liquid is supplied can be provided separately. As a result, even if ink leaks from the liquid supply port to which the liquid is supplied, the possibility that the leaked ink adheres to the first terminal to which the control signal is input can be reduced, and the possibility that the operational stability of the head unit is lowered can be reduced.

What is claimed is:

1. A liquid ejecting apparatus comprising:

a head unit that includes a nozzle that ejects a liquid;

a control circuit that outputs a control signal that controls an operation of the head unit;

a power supply circuit that supplies a power supply voltage to the head unit; and a liquid container that stores the liquid, wherein the head unit includes a first terminal to which the control signal is input, a second terminal to which the power supply voltage is supplied, and a liquid supply port to which the liquid is supplied, the first terminal and the second terminal are located side by side along a first direction, and the second terminal is located between the first terminal and the liquid supply port in a second direction intersecting the first direction.

2. The liquid ejecting apparatus according to claim 1, wherein the second terminal and the liquid supply port are located side by side along the first direction and a third direction different from the second direction.

3. The liquid ejecting apparatus according to claim 1, wherein the first terminal is located vertically above the liquid supply port.

4. The liquid ejecting apparatus according to claim 1, further comprising:

a position information detector that outputs a position information signal based on a relative positional relationship between the head unit and a medium on which the liquid is ejected, wherein the head unit includes a third terminal to which the position information signal is input, and the third terminal is located between the first terminal and the liquid supply port in the second direction.

5. The liquid ejecting apparatus according to claim 1, wherein the head unit includes a housing, and the first terminal, the second terminal, and the liquid supply port are located side by side along one side of the housing.

6. The liquid ejecting apparatus according to claim 5, wherein the first terminal, the second terminal, and the liquid supply port are located side by side along a long side of the housing.

7. The liquid ejecting apparatus according to claim 1, wherein the first terminal and the second terminal are provided on different connectors.

8. The liquid ejecting apparatus according to claim 1, wherein the first terminal is provided on a high-speed transmission connector.

9. The liquid ejecting apparatus according to claim 8, wherein the high-speed transmission connector is a USB connector.

10. A head unit comprising:

a first terminal to which a control signal is input;

a second terminal to which a power supply voltage is supplied; and a liquid supply port to which a liquid is supplied, wherein the second terminal is located between the first terminal and the liquid supply port in a second direction intersecting a first direction in which the first terminal and the second terminal are arranged.

* * * * *